US011048206B2

(12) United States Patent
Tajiri

(10) Patent No.: US 11,048,206 B2
(45) Date of Patent: Jun. 29, 2021

(54) MOTOR CONTROL APPARATUS AND IMAGE FORMING APPARATUS TO PREVENT A MOTOR CONTROL OPERATION FROM BECOMING UNSTABLE

(71) Applicant: CANON KABUSHIKI KAISHA, Tokyo (JP)

(72) Inventor: Tsuyoshi Tajiri, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/894,637

(22) Filed: Jun. 5, 2020

(65) Prior Publication Data

US 2020/0393790 A1 Dec. 17, 2020

(30) Foreign Application Priority Data

Jun. 11, 2019 (JP) ..... JP2019-108892

(51) Int. Cl.

*G03G 15/00* (2006.01)
*G03G 21/16* (2006.01)
*G03G 21/18* (2006.01)

(52) U.S. Cl.

CPC ..... *G03G 21/1676* (2013.01); *G03G 21/186* (2013.01)

(58) Field of Classification Search

CPC ..... G03G 15/757; G03G 21/1676; G03G 21/186; G03G 21/1857
USPC ..... 399/36, 167
See application file for complete search history.

(56) References Cited

U.S. PATENT DOCUMENTS 10,747,168 B2 * 8/2020 Ohashi et al. ..... G03G 21/1676
2011/0285332 A1 11/2011 Pollock
2014/0086639 A1 3/2014 Wakimoto

FOREIGN PATENT DOCUMENTS

JP 2005-39955 A 2/2005

* cited by examiner

*Primary Examiner* — William J Royer
(74) *Attorney, Agent, or Firm* — Canon U.S.A., Inc. I.P. Division

(57) ABSTRACT

An image forming apparatus includes a motor, a first coupling, an attachable/detachable unit, a detector, a phase determiner, and a controller. The motor rotates a rotary member through the first coupling and the attachable/detachable unit. The controller includes a first control mode and includes a second control mode. In the second control mode, in a case where a rotor load torque applied value is greater than a first predetermined value and a rotor rotational speed value is greater than a second predetermined value, the controller switches from the second control mode to the first control mode.

36 Claims, 15 Drawing Sheets

MOTOR CONTROL APPARATUS AND IMAGE FORMING APPARATUS TO PREVENT A MOTOR CONTROL OPERATION FROM BECOMING UNSTABLE

BACKGROUND

Field

The present disclosure relates to a motor control technique for a motor control apparatus and an image forming apparatus.

Description of the Related Art

A control method called vector control has been known as a control method for controlling a motor by controlling a current value in a rotating coordinate system based on a rotation phase of a rotor of the motor. Specifically, a control method for controlling a motor by performing phase feedback control to control a current value in a rotating coordinate system so as to reduce a deviation between a command phase and a rotation phase of a rotor is known. A control method for controlling a motor by performing speed feedback control is also known. For a speed feedback control, a current value in a rotating coordinate system is controlled so as to reduce a deviation between a command speed and a rotational speed of a rotor.

In vector control, a drive current flowing through each winding of a motor is represented by a q-axis component (torque current component), which is a current component for generating torque for rotating the rotor, and a d-axis component (exciting current component), which is a current component that affects the intensity of a magnetic flux penetrating the winding of the motor. Torque required to rotate the rotor is efficiently generated by controlling the value of the torque current component according to a change in load torque applied to the rotor. As a result, an increase in motor sound and an increase in power consumption due to excess torque are suppressed.

In vector control, a configuration for determining the rotation phase of the rotor is required. US 2011/0285332 discusses a configuration for determining a rotation phase of a rotor based on an induced voltage generated, by rotation of the rotor, in windings of respective phases of a motor.

As the rotational speed of the rotor decreases, the magnitude of the induced voltage generated in the windings decreases. If the magnitude of the induced voltage generated in the windings is not sufficient to determine the rotation phase of the rotor, the rotation phase may not be determined accurately. In other words, the accuracy for determining the rotation phase of the rotor may degrade with decreasing rotation speed of the rotor.

In this regard, Japanese Patent Application Laid-Open No. 2005-39955 discusses a configuration in which constant current control for controlling a motor by supplying a predetermined current to windings of the motor is used when a command speed of the rotor is lower than a predetermined rotation speed of the rotor. In constant current control, neither phase feedback control nor speed feedback control is performed. Japanese Patent Application Laid-Open No. 2005-39955 also discusses a configuration in which vector control is used when the command speed of the rotor is more than or equal to the predetermined rotational speed.

An image forming apparatus including a toner container that contains toner and is detachably attachable to the image forming apparatus has heretofore been known. US 2014/0086639 discusses a driving coupling provided in an image forming apparatus and a driven coupling provided in a toner container as a configuration for transmitting a driving force from a motor provided in the image forming apparatus to the toner container. The driving coupling that is rotationally driven by the motor presses the driven coupling in a rotation direction, so that the driven coupling is rotated. In this manner, the driving force is transmitted to the toner container from the motor.

When pressing of the driven coupling by the driving coupling is started, load torque applied to the rotor of the motor that drives the driving coupling increases. For example, in a case where pressing of the driven coupling by the driving coupling is started immediately after a motor control method is switched from constant current control to vector control, the following matters may arise.

Specifically, if the load torque increases after pressing of the driven coupling by the driving coupling is started, the rotational speed of the rotor of the motor decreases. If the rotational speed of the rotor of the motor decreases immediately after the motor control method is switched from constant current control to vector control, the rotation phase of the rotor of the motor cannot be determined accurately. As a result, vector control cannot be performed accurately and thus the motor control operation may become unstable.

SUMMARY OF THE INVENTION

To address matters in this disclosure, the present disclosure is directed to preventing a motor control operation from becoming unstable.

According to an aspect of the present disclosure, an image forming apparatus that forms an image on a sheet includes a motor, a first coupling configured to transmit a driving force from the motor, an attachable/detachable unit configured to be detachably attachable to the image forming apparatus, wherein the attachable/detachable unit includes a second coupling configured to transmit the driving force from the first coupling to a rotary member included in the attachable/detachable unit, a detector configured to detect a drive current flowing through a winding of the motor, a phase determiner configured to determine a rotation phase of a rotor of the motor based on the drive current detected by the detector, and a controller including a first control mode for controlling the drive current flowing through the winding to reduce a deviation between a command phase representing a target phase of the rotor and the rotation phase determined by the phase determiner, and a second control mode for controlling the drive current flowing through the winding based on a current of a predetermined magnitude, wherein one of the first coupling and the second coupling includes a projecting portion, and the other one of the first coupling and the second coupling includes a recessed portion corresponding to the projecting portion, wherein, in a state where the projecting portion is fit to the recessed portion, the second coupling is rotated by being pressed in a rotation direction by the first coupling rotationally driven by the motor, wherein the controller starts driving of the motor in the second control mode, and wherein, in a state where the second control mode is executed in a case where a value corresponding to load torque applied to the rotor is greater than a first predetermined value and a value corresponding to a rotational speed of the rotor is greater than a second predetermined value, the controller switches a control mode for controlling the drive current from the second control mode to the first control mode.

Further features of the present disclosure will become apparent from the following description of exemplary embodiments with reference to the attached drawings.

. 14 is a flowchart illustrating a method for controlling the motor by the motor control apparatus.

Figure 15:
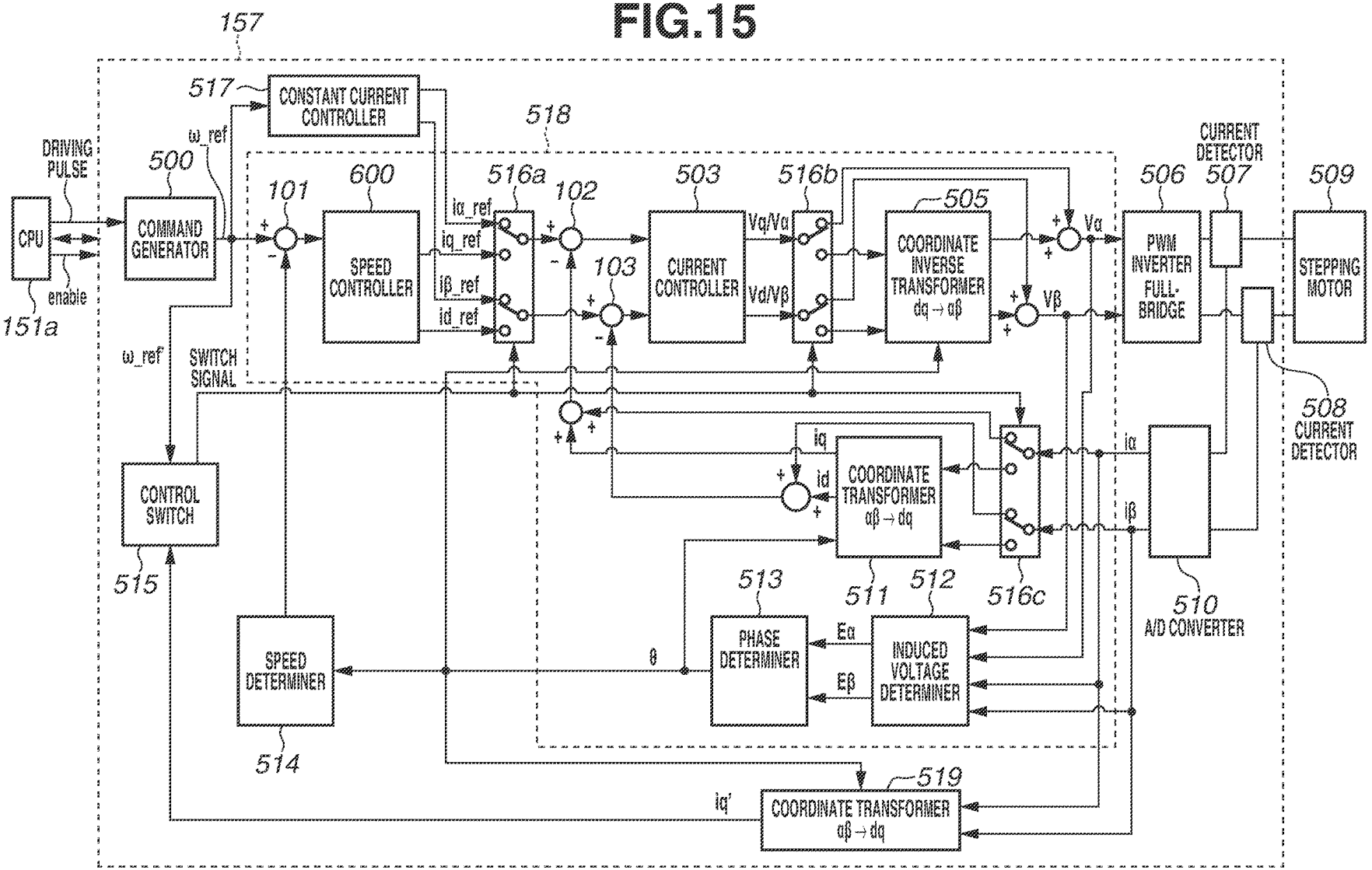

FIG. 15 is a block diagram illustrating the configuration of the motor control apparatus that performs speed feedback control.

DESCRIPTION OF THE EMBODIMENTS

Preferred exemplary embodiments of the present disclosure will be described below with reference to the accompanying drawings. The shapes of components described in the exemplary embodiments, the relative arrangement of the components, and the like should be appropriately modified in accordance with the configuration of an apparatus to which the present disclosure is applied and various conditions, and the scope of the present disclosure is not limited to the following exemplary embodiments. Moreover, the following exemplary embodiments illustrate a case where a motor control apparatus is provided in an image forming apparatus 100. However, the motor control apparatus is not necessarily provided in the image forming apparatus 100. For example, the motor control apparatus may also be used as a sheet conveying device that conveys a recording medium and a sheet such as a document.

[Image Forming Apparatus]

Figure 1:
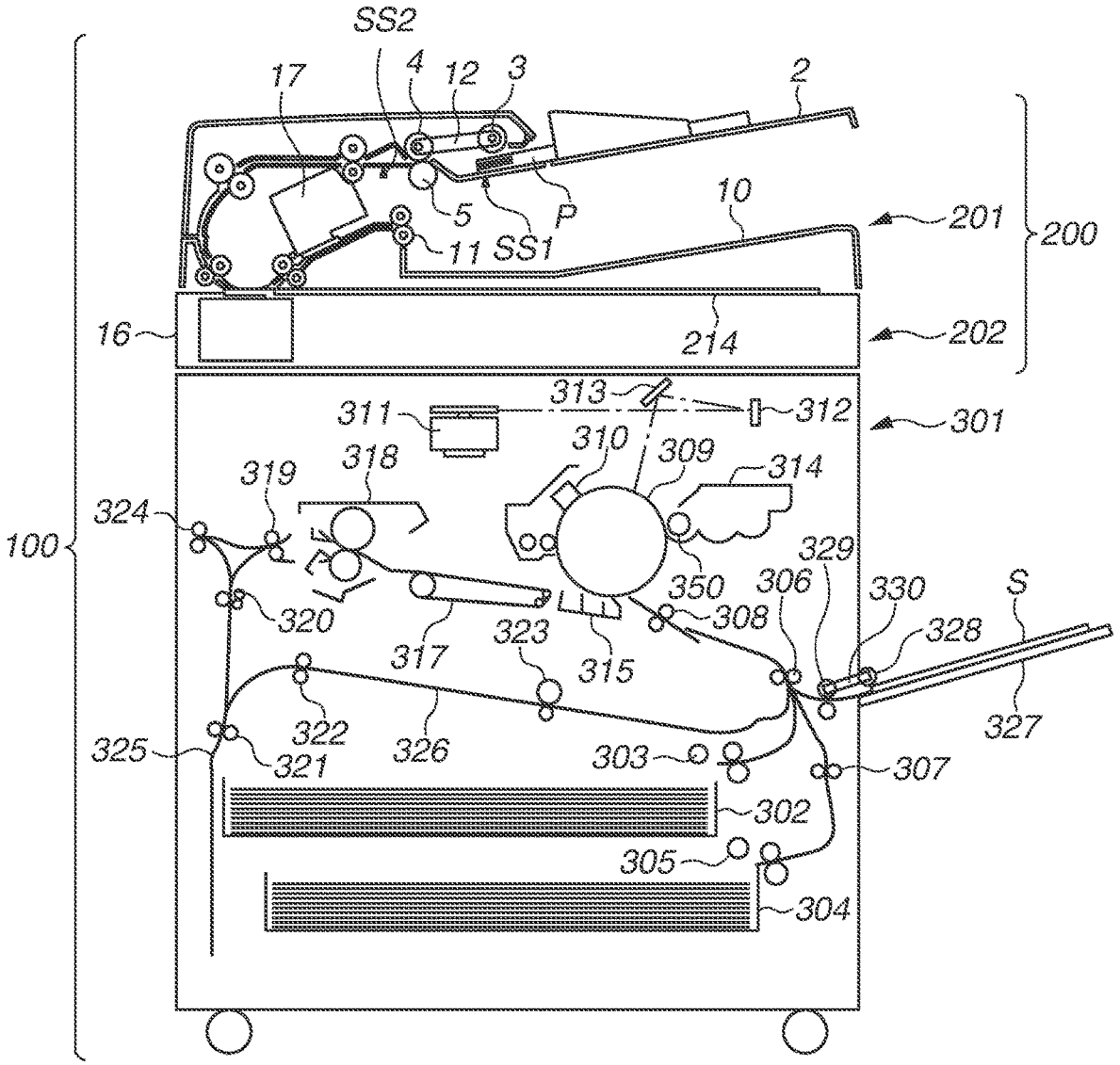
FIG. 1 is a sectional view illustrating an image forming apparatus according to a first exemplary embodiment.

FIG. 1 is a sectional view illustrating a configuration of a monochromatic electrophotographic copying machine 100 (hereinafter referred to as an image forming apparatus 100) including a sheet conveying device used in a first exemplary embodiment. The image forming apparatus 100 is not limited to a copying machine, but instead may be, for example, a facsimile apparatus, a printing machine, or a printer. The recording method is not limited to an electrophotographic method, but instead may be, for example, an inkjet method. Further, the type of the image forming apparatus 100 may be a monochrome type or a color type.

The configuration and functions of the image forming apparatus 100 will be described below with reference to FIG. 1. As illustrated in FIG. 1, the image forming apparatus 100 includes a document reading device 200 and an image printing device 301.

<Document Reading Device>

The document reading device 200 is provided with a document feeding device that feeds a document to a reading position. Documents P stacked on a document stacking portion 2 of the document feeding device 201 are fed one by one by a pickup roller 3 and are then conveyed by a sheet teed roller 4. A separation roller 5 that is in pressure contact with the sheet feed roller 4 is provided at a position opposed to the sheet feed roller 4. The separation roller 5 is configured to rotate when load torque more than or equal to predetermined torque is applied to the separation roller 5, and has a function for separating documents fed in a state where two sheets are superimposed.

The pickup roller 3 and the sheet feed roller 4 are coupled by a rocking arm 12. The rocking arm 12 is supported by a rotating shaft of the sheet feed roller 4 so that the rocking arm 12 can be rotated about the rotating shaft of the sheet feed roller 4.

Each document P is conveyed by the sheet feed roller 4 and the like and is then discharged onto a discharge tray 10 by a discharge roller 11. As illustrated in FIG. 1, the document stacking portion 2 is provided with a document setting sensor SS1 that detects whether a document is stacked on the document stacking portion 2. In addition, a sheet sensor SS2 that detects a leading edge of a document (detects whether a document is present) is provided at a conveyance path through which the document passes.

The document reading device 200 is provided with a document reading portion 16 that reads an image on a first surface of the conveyed document. Image information obtained by reading the image by the document reading portion 16 is output to the image printing device 301.

The document reading device 200 is also provided with a document reading portion 17 that reads an image on a second surface of the conveyed document. Image information obtained by reading the image by the document reading portion 17 is output to the image printing device 301 in the same manner as the document reading portion 16 described above.

A document reading operation is carried out as described above. That is, the document feeding device 201 and a reading device 202 function as the document reading device 200.

A first reading mode and a second reading mode are used as document reading modes. The first reading mode is a mode for reading an image on a conveyed document by the above-described method. The second reading mode is a mode in which an image on a document placed on a document glass 214 of the reading device 202 is read by the document reading portion 16 that moves at a constant speed. In a normal operation, an image on a sheet-like document is read in the first reading mode, and images on bound documents, such as a book or booklet, are read in the second reading mode.

Sheet accommodating trays 302 and 304 are provided in the image printing device 301. Different types of recording media can he accommodated in the sheet accommodating trays 302 and 304, respectively. For example, A4-size plain paper is accommodated in the sheet accommodating tray 302, and A4-size thick paper is accommodated in the sheet accommodating tray 304. Each of the recording media is a medium on which an image is formed by the image forming apparatus 100. Examples of the recording media include a sheet, a resin sheet, cloth, an overhead projector (OHP) sheet, and a label.

The recording media accommodated in the sheet accommodating tray 302 are fed by a sheet feed roller 303 and delivered to registration rollers 308 by conveyance rollers 306. The recording media accommodated in the sheet accommodating tray 304 are fed by a sheet feed roller 305 and conveyance rollers 307 and delivered to the registration rollers 308 by the conveyance rollers 306. Alternatively, sheet S may be fed from a sheet feed tray 327 by rollers 328 and 329 as supported by rocking arm 330 and delivered to the registration rollers 308 by the conveyance rollers 306.

An image signal output from the document reading device 200 is input to an optical scanning device 311 including a semiconductor laser and a polygon mirror. An outer peripheral surface of a photosensitive drum 309 serving as a photosensitive member is charged by a charger 310. After the outer peripheral surface of the photosensitive drum 309 is charged, laser light corresponding to the image signal input from the document reading device 200 to the optical scanning device 311 passes through the polygon mirror and a mirror 312 and 313 from the optical scanning device 311, and is then applied to the outer peripheral surface of the photosensitive drum 309. As a result, an electrostatic latent image is formed on the outer peripheral surface of the photosensitive drum 309.

A developing device 314 serving as a developing unit includes a developing roller 350 serving as a developer bearing member. The electrostatic latent image formed on the outer peripheral surface of the photosensitive drum 309 is developed by developer (toner) borne on the developing roller 350, so that a toner image is formed on the outer peripheral surface of the photosensitive drum 309. The toner image formed on the photosensitive drum 309 is transferred onto a recording medium by a transfer charger 315 serving as a transfer portion provided at a position (transfer position) opposed to the photosensitive drum 309. In accordance with this transfer timing, the recording medium is fed to the transfer position by the registration rollers 308.

As described above, the recording medium to which the toner image is transferred is fed to a fixing unit 318 by a conveyance belt 317 and is heated and pressurized by the fixing unit 318, so that the toner image is fixed onto the recording medium. In this manner, an image is formed on the recording medium by the image forming apparatus 100.

In the case of forming an image in a single-sided printing mode, the recording medium which has passed through the fixing unit 318 is discharged onto a discharge tray (not illustrated) by discharge rollers 319 and discharge rollers 324. In the case of forming an image in a double-sided printing mode, a fixing processing is performed on the first surface of the recording medium by the fixing unit 318. Then, the recording medium is conveyed to a reverse path 325 by the discharge rollers 319, conveyance rollers 320, and inverting rollers 321. After that, the recording medium is conveyed to the registration rollers 308 again by conveyance rollers 322 and conveyance rollers 323 along path 326, so that an image is formed on the second surface of the recording medium by the above-described method. Then, the recording medium is discharged onto the discharge tray (not illustrated) by the discharge rollers 319 and the discharge rollers 324.

In a case where the recording medium having an image formed on the first surface is discharged to the outside of the image forming apparatus 100 in a state where the first surface of the recording medium faces downward, the recording medium which has passed through the fixing unit 318 passes through the discharge rollers 319 and is then conveyed toward the conveyance rollers 320. After that, the rotation of the conveyance rollers 320 is reversed immediately before a trailing edge of the recording medium passes through a nip portion between the conveyance rollers 320, so that the recording medium passes through the discharge rollers 324 in a state here the first surface of the recording medium faces downward and is then discharged to the outside of the image forming apparatus 100.

The configuration and functions of the image forming apparatus 100 are described above.

Figure 2:
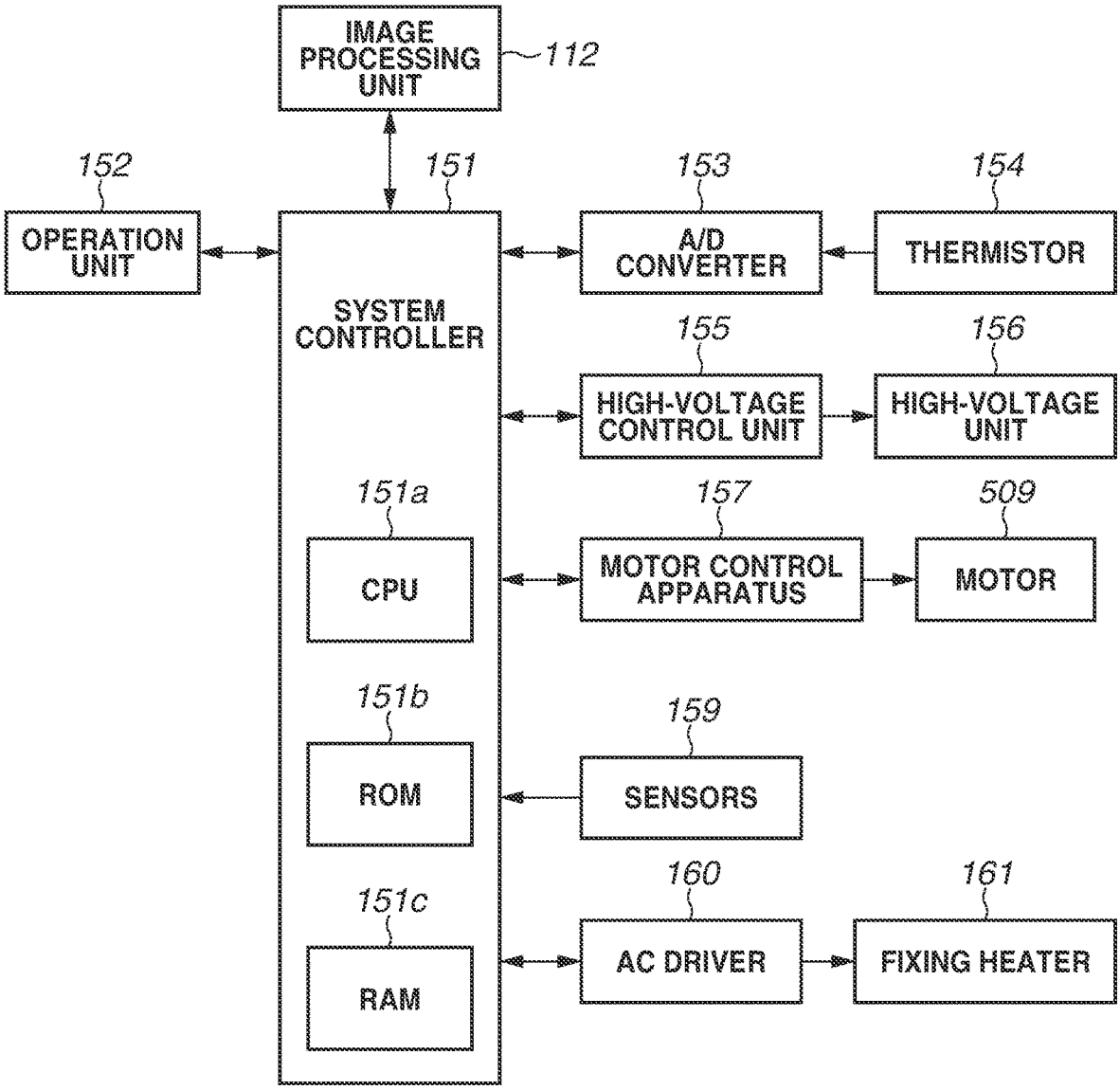
FIG. 2 is a block diagram illustrating a control configuration of the image forming apparatus.

FIG. 2 is a block diagram illustrating an example of a control configuration of the image forming apparatus 100. As illustrated in FIG. 2, a system controller 151 includes a central processing unit (CPU) 151*a*, a read-only memory (ROM) 151*b*, and a random access memory (RAM) 151*c*. The system controller 151 is connected to each of an image processing unit 112, an operation unit 152, an analog-to-digital (A/D) converter 153, a high-voltage control unit 155, a motor control apparatus 157, sensors 159, and an alternating current (AC) driver 160. The system controller 151 can transmit and receive data and commands to and from each of the connected units.

The CPU 151*a* reads out various programs stored in the ROM 151*b* and executes the programs to thereby execute various sequences related to a predetermined image formation sequence.

The RAM 151*c* is a storage device. The RAM 151*c* stores various data, such as setting values for the high-voltage control unit 155, command values for the motor control apparatus 157, and information received from the operation unit 152.

The system controller 151 transmits setting value data, which is used for various devices provided in the image forming apparatus 100 to execute image processing in the image processing unit 112, to the image processing unit 112. Further, the system controller 151 receives signals from the sensors 159, and sets setting values for the high-voltage control unit 155 based on the received signals.

The high-voltage control unit 155 supplies a high-voltage unit 156 (the charger 310, the developing device 314, the transfer charger 315, etc.) with a required voltage depending on the setting values set by the system controller 151. The sensors 159 include a sensor for detecting a recording medium to be conveyed by the conveyance rollers.

The motor control apparatus 157 controls a stepping motor 509, which drives a load, according to a command output from the CPU 151*a*. FIG. 2 illustrates only the stepping motor 509 as a motor for the image forming apparatus 100. However, in practice, the image forming apparatus 100 is provided with a plurality of motors. Alternatively, a single motor control apparatus may be configured to control a plurality of motors. FIG. 2 illustrates only one motor control apparatus 157. However, in practice, the image forming apparatus 100 may be provided with a plurality of motor control apparatuses.

The A/D converter 153 receives a detection signal detected by a thermistor 154 for detecting the temperature of a fixing heater 161, converts the detection signal from an analog signal into a digital signal, and transmits the digital signal to the system controller 151. The system controller 151 controls the AC driver 160 based on the digital signal received from the A/D converter 153. The AC driver 160 controls the fixing heater 161 so that the temperature of the fixing heater 161 reaches a temperature for fixing processing. The fixing heater 161 is a heater that is used for fixing processing and included in the fixing unit 318.

The system controller 151 controls the operation unit 152 so that an operation screen used for a user to set, for example, a type of a recording medium to be used (hereinafter referred to as a sheet type), is displayed on a display unit provided on the operation unit 152, The system controller 151 receives information set by the user from the operation unit 152, and controls operation sequences for the image forming apparatus 100 based on the information set by the user. Further, the system controller 151 transmits information indicating the state of the image forming apparatus 100 to the operation unit 152. Examples of the information indicating the state of the image forming apparatus 100 include the number of images to be formed, a progress status of an image formation operation, and information about jamming, double feeding, or the like of sheets in the document reading device 200 and the image printing device 301. The operation unit 152 displays the information received from the system controller 151 on the display unit.

As described above, the system controller 151 controls the operation sequences for the image forming apparatus 100.

[Motor Control Apparatus]

Next, the motor control apparatus 157 according to the present exemplary embodiment will be described. The motor control apparatus 157 according to the present exemplary embodiment can control the stepping motor 509 by using two control methods, i.e., a vector control method as a first control mode and a constant current control method as a second control mode. In the following exemplary embodiment, the control operation is performed as described below based on a rotation phase θ as an electrical angle, a command phase θ_ref, a current phase, and the like. However, for example, the control operation may be performed as described below based on a mechanical angle converted from an electrical angle.

<Vector Control>

A method in which the motor control apparatus 157 according to the present exemplary embodiment performs vector control will now be described with reference to FIGS. 3 and 4. In the following exemplary embodiment, the stepping motor 509 is not provided with any sensor such as a rotary encoder for detecting a rotation phase of a rotor of the stepping motor 509.

Figure 3:
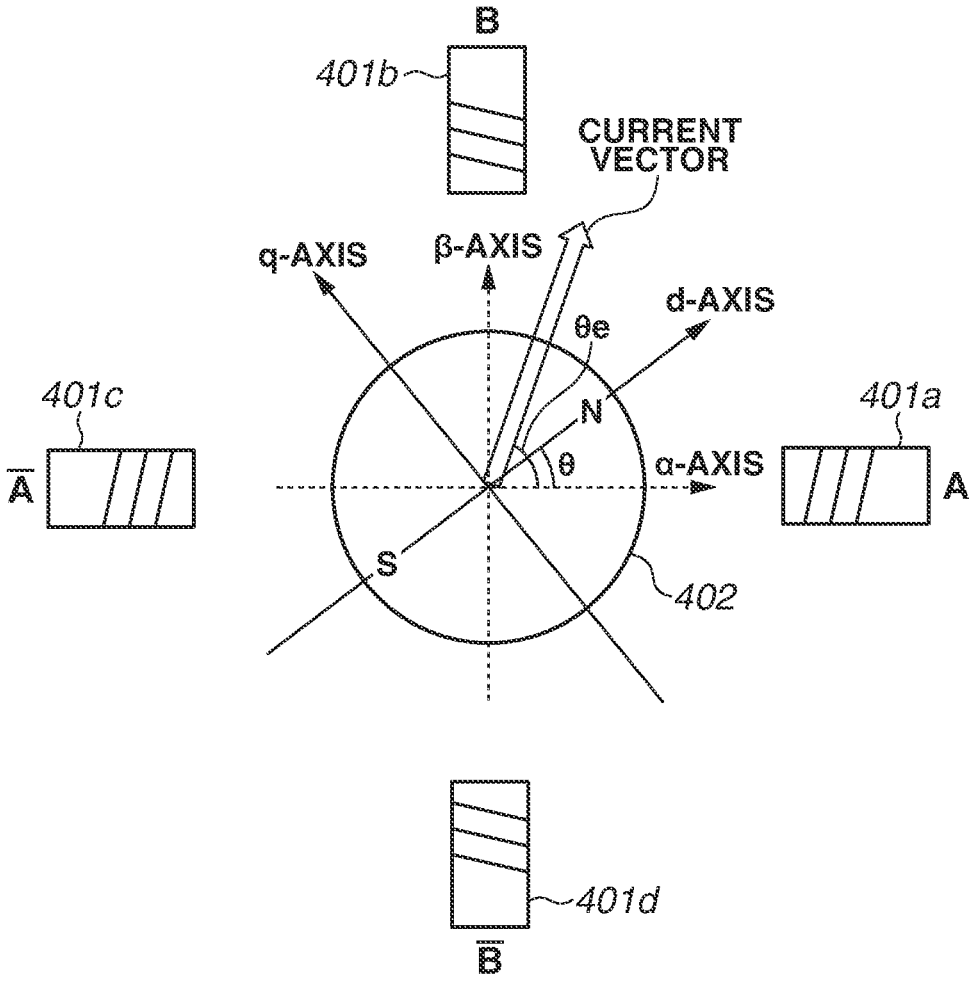
FIG. 3 illustrates a relationship between a two-phase motor having an A-phase and a B-phase, and a rotating coordinate system represented by a d-axis and a q-axis.

FIG. 3 illustrates a relationship between the stepping motor 509 (hereinafter referred to as the motor 509) having two phases, i.e., an A-phase (first phase) and a B-phase (second phase), and a rotating coordinate system represented by a d-axis and a q-axis. As illustrated in FIG. 3, an a-axis corresponding to an A-phase winding 401*a*/401*c* and a 3-axis corresponding to a B-phase winding 401*b*/401*d* are defined in a stationary coordinate system. As illustrated in FIG. 3, a d-axis is defined along the direction of a magnetic flux generated by magnetic poles of a permanent magnet used as a rotor 402, and a q-axis is defined along the direction which leads the d-axis by 90 degrees in a counterclockwise direction (along the direction perpendicular to the d-axis). An angle formed between the a-axis and the d-axis is defined as θ, and the rotation phase of the rotor 402 is represented by the angle θ. In vector control, the rotating coordinate system based on the rotation phase θ of the rotor 402 is used. Specifically, in vector control, a q-axis component (torque current component) that generates torque in the rotor 402 and a d-axis component (exciting current component) that affects the intensity of the magnetic flux penetrating the windings are used. The q-axis component and the d-axis component are current components in the rotating coordinate system of current vectors corresponding to drive currents flowing through the windings.

The vector control is a control method for controlling the motor 509 by performing phase feedback control for controlling the value of the torque current component and the value of the exciting current component so as to reduce a deviation between the command phase θ_ref representing a target phase of the rotor 402 and an actual rotation phase. In addition, a method for controlling the motor 509 by performing speed feedback control for controlling the value of the torque current component and the value of the exciting current component so as to reduce a deviation between a command speed representing a target speed of the rotor 402 and an actual rotational speed can be used.

Figure 4:
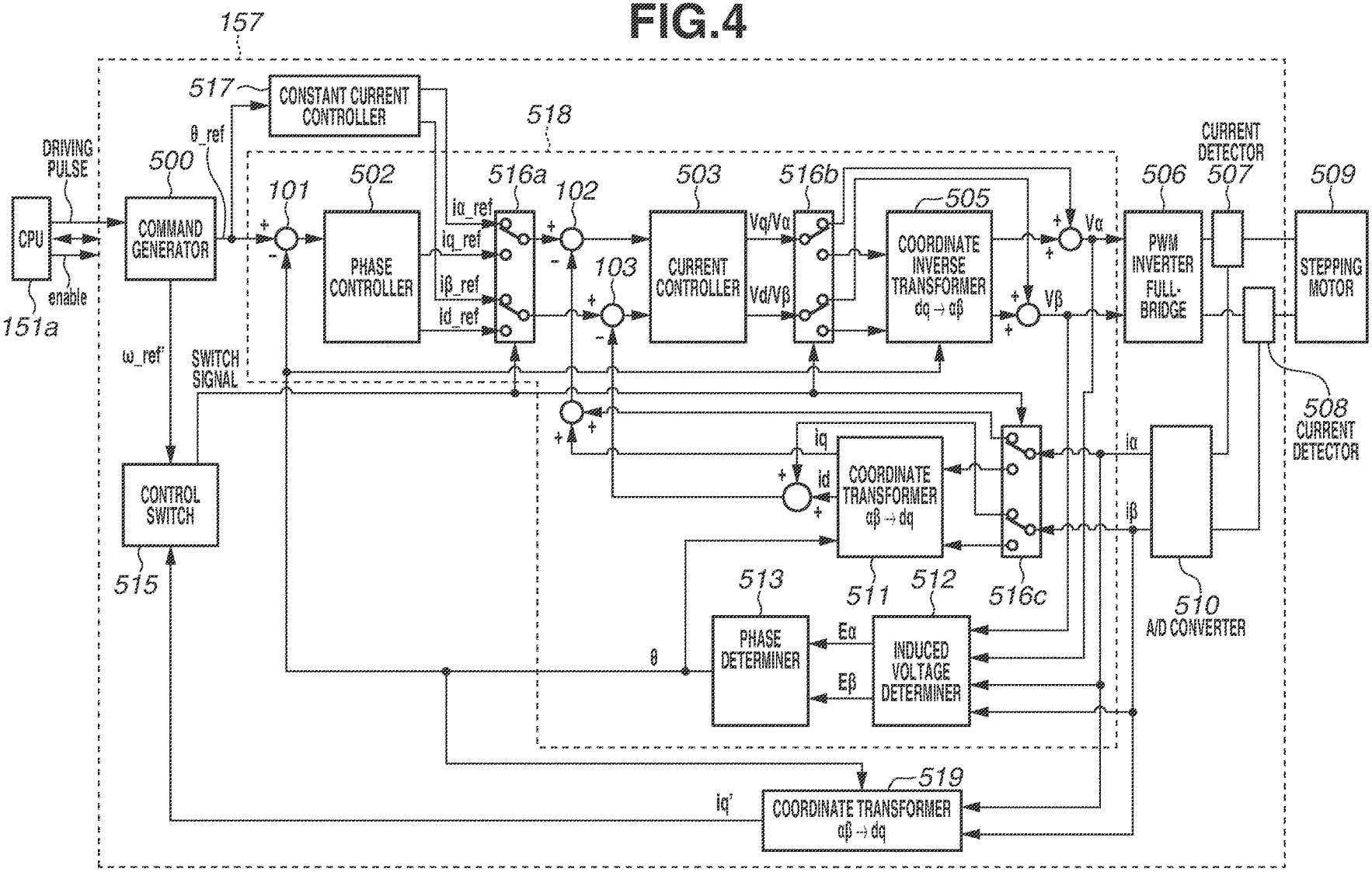
FIG. 4 is a block diagram illustrating a configuration of a motor control apparatus according to the first exemplary embodiment.

FIG. 4 is a block diagram illustrating an example of the configuration of the motor control apparatus 157 that controls the motor 509. The motor control apparatus 157 is configured using at least one application specific integrated circuit (ASIC), and executes functions to be described below.

As illustrated in FIG. 4, the motor control apparatus 157 includes a constant current controller 517 that performs constant current control, and a vector controller 518 that performs vector control.

The motor control apparatus 157 includes, as one or more circuits for performing vector control, a phase controller 502, a current controller 503, a coordinate inverse transformer 505, a coordinate transformer 511, and a pulse-width modulation (PWM) inverter 506 for supplying drive currents to the windings of the motor 509. The coordinate transformer 511 transforms the current vector corresponding to the drive currents flowing through the A-phase winding 401*a*/401*c* and 13-phase windings 401*b*/401*d* of the motor 509 from the stationary coordinate system represented by the α-axis and β-axis into the rotating coordinate system represented by the q-axis and d-axis. As a result, the drive currents flowing through the windings can be represented by a current value (q-axis current) of the q-axis component and a current value (d-axis current) of the d-axis component, which are current values in the rotating coordinate system. The q-axis current corresponds to the torque current that generates torque in the rotor 402 of the motor 509. The d-axis current corresponds to the exciting current that affects the intensity of the magnetic flux penetrating the windings of the motor 509. The motor control apparatus 157 can independently control the q-axis current and the d-axis current. As a result, the motor control apparatus 157 controls the q-axis current depending on the load torque applied to the rotor 402, thereby making it possible to efficiently generate torque for rotating the rotor 402. That is, in vector control, the magnitude of the current vector illustrated in FIG. 3 varies depending on the load torque applied to the rotor 402.

The motor control apparatus 157 determines the rotation phase θ of the rotor 402 of the motor 509 by the following method, and performs vector control based on the determination result. The CPU 151*a* outputs driving pulses as commands for driving the motor 509 to a command generator 500 based on the operation sequence for the motor 509. The operation sequence (motor driving pattern) for the motor 509 is stored in, for example, the ROM 151*b*, and the CPU 151*a* outputs the driving pulses based on the operation sequences stored in the ROM 151*b*.

The command generator 500 generates the command phase θ_ref representing the target phase of the rotor 402 based on the driving pulses output from the CPU 151*a*, and outputs the generated command phase θ_ref. The configuration of the command generator 500 will be described below.

A subtractor 101 calculates a deviation between the rotation phase θ and the command phase θ_ref of the rotor 402. of the motor 509, and outputs the calculated deviation.

The phase controller 502 acquires a deviation Δθ for a cycle 200 $_i$ts). The phase controller 502. generates a q-axis current command value iq_ref and a d-axis current command value id_ref based on proportional control (P), integral control (I), and differential control (D) so as to reduce the deviation Δθ acquired from the subtractor 101, and outputs the generated q-axis current command value iq_ref and d-axis current command value id_ref. Specifically, the phase controller 502 generates the q-axis current command value iq_ref and the d-axis current command value id_ref based on the P-control, the I-control, and the D-control so that the deviation Δθ acquired from the subtractor 101 becomes zero, and outputs the generated q-axis current command value iq_ref and d-axis current command value id_ref. The P-control is a control method for controlling a value to be controlled based on a value proportional to a deviation between a command value and an estimated value. The I-control is a control method for controlling a value to be controlled based on a value proportional to a time integral of a deviation between a command value and an estimated value. The D-control is a control method for controlling a value to be controlled based on a value proportional to a time change of a deviation between a command value and an estimated value. The phase controller 502 according to the present exemplary embodiment generates the q-axis current command value iq_ref and d-axis current command value id_ref based on the P-control. the I-control, and the D-control. However, the configuration of the phase controller 502 according to the present exemplary embodiment is not limited to this example. For example, the phase controller 502 may generate the q-axis current command value iq_ref and d-axis current command value id_ref based on the P-control and the I-control. In the present exemplary embodiment, the d-axis current command value id_ref that affects the intensity of the magnetic flux penetrating the windings is set to "0". However, the present exemplary embodiment is not limited to this example.

The drive current flowing through the A-phase winding 401*a*/401*c* of the motor 509 is detected by a current detector 507, and is then converted from an analog value into a digital value by an A/D converter 510. The drive current flowing through the B-phase winding 401*b*/401*d* of the motor 509 is detected by a current detector 508 and is then converted from an analog value into a digital value by the A/D converter 510. A cycle at which the current detectors 507 and 508 detect a current is, for example, a cycle (e.g., 25 μs) that is less than or equal to the cycle T in which the deviation Δθ is acquired by the phase controller 502.

The current values of the drive currents converted from the analog value into the digital value by the A/D converter 510 are represented as current values iα and iβ in the stationary coordinate system by the following formulas using a phase θe of the current vector illustrated in FIG. 1. The phase θe of the current vector is defined as an angle formed between the α-axis and the current vector. I represents the magnitude of the current vector $$i\alpha = I^* \cos \theta e \quad (1)$$

$$i\beta = I^* \sin \theta e \quad (2)$$

These current values iα and iβ are input to each of the coordinate transformer 511, a coordinate transformer 519, and an induced voltage determiner 512.

The coordinate transformer 511 converts the current values iα and iβ in the stationary coordinate system into a current value iq of the q-axis current and a current value id of the d-axis current, respectively, in the rotating coordinate system by the following formulas.

$$id = \cos \theta^* i\alpha + \sin \theta^* i\beta \quad (3)$$

$$iq = -\sin \theta^* i\alpha + \cos \theta^* i\beta \quad (4)$$

The coordinate transformer 511 outputs the converted current value iq to a subtractor 102. The coordinate transformer 511 outputs the converted current value id to a subtractor 103.

The subtractor 102 calculates a deviation between the q-axis current command value iq_ref and the current value iq, and outputs the deviation to the current controller 503.

The subtractor 103 calculates a deviation between the d-axis current command value id_ref and the current value id, and outputs the deviation to the current controller 503.

The current controller 503 generates drive voltages Vq and Vd based on the P-control, the I-control, and the D-control so as to reduce the deviation to be input. Specifically, the current controller 503 generates the drive voltages Vq and Vd so that the deviation to be input becomes zero, and outputs the generated drive voltages Vq and Vd to the coordinate inverse transformer 505. The current controller 503 according to the present exemplary embodiment generates the drive voltages Vq and Vd based on the P-control, the I-control, and the D-control. However, the configuration of the current controller 503 according to the present exemplary embodiment is not limited to this example. For example, the current controller 503 may generate the drive voltages Vq and Vd based on the P-control and the I-control.

The coordinate inverse transformer 505 inversely transforms the drive voltages Vq and Vd in the rotating coordinate system output from the current controller 503 into drive voltages Vα and Vβ, respectively, in the stationary coordinate system by the following formulas.

$$V\alpha = \cos \theta^* Vd - \sin \theta^* Vq \quad (5)$$

$$V\beta = \sin \theta^* Vd + \cos \theta^* Vq \quad (6)$$

The coordinate inverse transformer 505 outputs the inversely transformed drive voltages Vα and Vβ to each of the induced voltage determiner 512 and the PWM inverter 506.

The PWM inverter 506 includes a full-bridge circuit. The full-bridge circuit is driven by a PWM signal based on the drive voltages Vα and Vβ received from the coordinate inverse transformer 505. As a result, the PWM inverter 506 generates the drive currents iα and iβ corresponding to the drive voltages Vα and Vβ, respectively, and supplies the generated drive currents iα and iβ to the windings of respective phases of the motor 509, thereby driving the motor 509. In the present exemplary embodiment, the PWM inverter 506 includes a full-bridge circuit, but instead may include a half-bridge circuit or the like.

Next, a configuration for determining the rotation phase θ will be described. To determine the rotation phase θ of the rotor 402, values of induced voltages Eα and Eβ induced to the A-phase winding 401*a*/401*c* and B-phase winding 401*b*/401*d* of the motor 509 by rotation of the rotor 402 are used. The values of the induced voltages Eα and Eβ are determined (calculated) by the induced voltage determiner 512.

Specifically, the induced voltages Eα and Eβ are determined by the following formulas based on the current values iα and iβ input to the induced voltage determiner 512 from the A/D converter 510 and the drive voltages Vα and Vβ input to the induced voltage determiner 512 from the coordinate inverse transformer 505.

$$E\alpha = V\alpha - R*i\alpha - L*di\alpha/dt \quad (7)$$

$$E\beta = V\beta - R*i\beta - L*di\beta/dt \quad (8)$$

In formulas (7) and (8), R represents a winding resistance and L represents a winding inductance. The values of the winding resistance R and the winding inductance L are values unique to the motor 509 to be used, and are preliminarily stored in the ROM 151*b*, a memory (not illustrated) provided in the motor control apparatus 157, or the like.

The induced voltages Eα and Eβ determined by the induced voltage determiner 512 are output to a phase determiner 513.

The phase determiner 513 determines the rotation phase θ of the rotor 402 of the motor 509 by the following formula based on a ratio between the induced voltage Eα and the induced voltage Eβ output from the induced voltage determiner 512.

$$\theta = \tan\hat{}-1(-E\beta/E\alpha) \quad (9)$$

In the present exemplary embodiment, the phase determiner 513 determines the rotation phase θ by the calculation based on formula (9), but instead may determine the rotation phase θ by other methods. For example, the phase determiner 513 may determine the rotation phase θ by referring to a table that is stored in the ROM 151*b* or the like and represents the relationship between the induced voltages Eα and Eβ and the rotation phase θ corresponding to the induced voltages Eα and Eβ.

The rotation phase θ of the rotor 402. obtained as described above is input to each of the subtractor 101, the coordinate inverse transformer 505, and the coordinate transformers 511 and 519.

In the case of performing vector control, the motor control apparatus 157 repeatedly performs the above-described control operation.

As described above, the motor control apparatus 157 according to the present exemplary embodiment performs vector control using the phase feedback control for controlling the current values in the rotating coordinate system so as to reduce the deviation between the command phase θ_ref and the rotation phase θ. The vector control prevents the motor 509 from entering a step-out state and suppresses an increase in motor sound and an increase in power consumption due to excess torque.

<Constant Current Control>

Next, constant current control according to the present exemplary embodiment will be described.

In constant current control, a predetermined current is supplied to each winding of the motor 509, to thereby control the drive current flowing through the winding. Specifically, in constant current control, a drive current having a magnitude (amplitude) corresponding to torque obtained by adding a predetermined margin to torque assumed to be required for rotating the rotor 402 is supplied to the winding so as to prevent the motor 509 from entering a step-out state even when the load torque applied to the rotor 402 fluctuates. This is because, in constant current control, the configuration in which the magnitude of the drive current is controlled based on the determined (estimated) rotation phase and rotational speed is not used (feedback control is not performed), and thus the drive current cannot be adjusted depending on the load torque applied to the rotor 402. As the magnitude of a current increases, torque to be applied to the rotor 402 increases. The amplitude of a current corresponds to the magnitude of a current vector.

In the following exemplary embodiment, when the constant current control is executed, the motor 509 is controlled by supplying a current of a predetermined magnitude to each winding of the motor 509. In contrast, for example, when the constant current control is executed, the motor 509 may be controlled by supplying the current of the predetermined magnitude, which is determined depending on acceleration or deceleration of the motor 509, to each winding of the motor 509.

Referring to FIG. 4, the command generator 500 outputs the command phase θ_ref to the constant current controller 517 based on the driving pulses output from the CPU 151*a*. The constant current controller 517 generates current command values iα_ref and iβ_ref in the stationary coordinate system corresponding to the command phase θ_ref output from the command generator 500, and outputs the generated current command values iα_ref and iβ_ref, In the present exemplary embodiment, the magnitudes of current vectors corresponding to the current command values iα_ref and iβ_ref in the stationary coordinate system are constant.

The drive currents flowing through the A-phase winding 401*a*/401*c* and B-phase winding 401*b*/401*d* of the motor 509 are detected by the current detectors 507 and 508, respectively. As described above, the detected drive currents are each converted from an analog value into a digital value by the A/D converter 510.

The subtractor 102 receives the current value iα output from the A/D converter 510 and the current command value iα_ref output from the constant current controller 517. The subtractor 102 calculates a deviation between the current command value iα_ref and the current value iα, and outputs the deviation to the current controller 503.

The subtractor 103 receives the current value iβ output from the A/D converter 510 and the current command value iβ_ref output from the constant current controller 517. The subtractor 103 calculates a deviation between the current command value iβ_ref and the current value iβ, and outputs the deviation to the current controller 503.

The current controller 503 outputs the drive voltages Vα and Vβ based on the P-control, the I-control, and the D-control so as to reduce the deviation to be input. Specifically, the current controller 503 outputs the drive voltages Vα and Vβ so that the deviation to be input approaches zero.

The PWM inverter 506 drives the motor 509 by supplying the drive currents to the windings of the respective phases of the motor 509 based on the input drive voltages Vα and Vβ the above-described method.

Thus, in constant current control according to the present exemplary embodiment, neither phase feedback control nor speed feedback control is performed. In other words, in constant current control according to the present exemplary embodiment, the drive currents to be supplied to the windings are not adjusted depending on the rotating status of the rotor 402. Accordingly, in constant current control, a current obtained by adding a predetermined margin to a current for rotating the rotor 402 is supplied to the windings so as to prevent the motor 509 from entering a step-out state.

<Command Generator>

Figure 5:
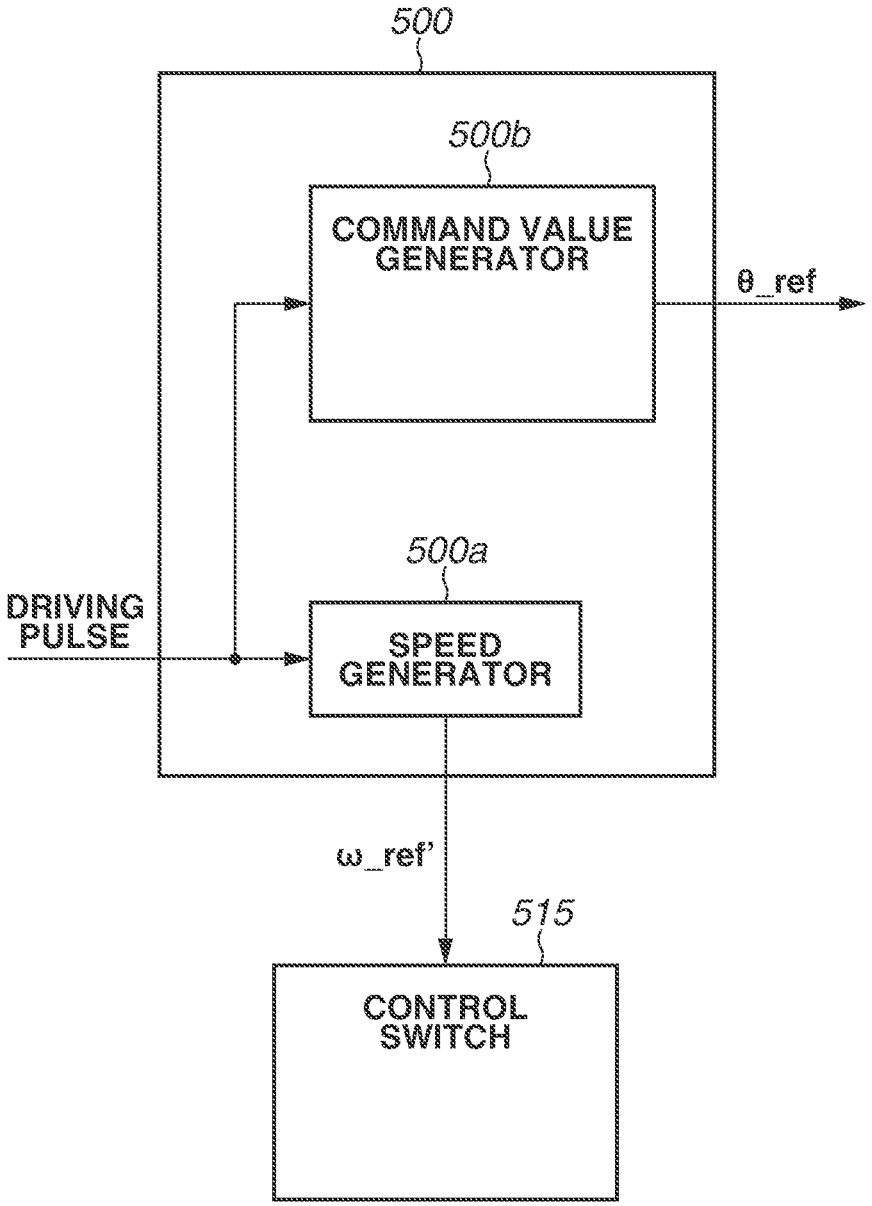
FIG. 5 is a block diagram illustrating a configuration of a command generator.

FIG. 5 is a block diagram illustrating the configuration of the command generator 500 according to the present exemplary embodiment. As illustrated in FIG. 5, the command generator 500 includes a speed generator 500*a* that generates a rotational speed ω_ref in place of a command speed, and a command value generator 500*b* that generates the command phase θ_ref based on the driving pukes output from the CPU 151*a*.

The speed generator 500*a* generates the rotational speed ω_ref based on a time interval of falling edges of continuous driving pulses, and outputs the generated rotational speed ω_ref. That is, the rotational speed ω_ref varies at the cycle corresponding to the cycle of driving pulses.

The command value generator 500*b* generates the command phase θ_ref by the following formula (10) based on the driving pulses output from the CPU 151*a*, and outputs the generated command phase θ_ref $$\theta_ref=\theta ini+\theta step*n \quad (10)$$

In formula (10), θini represents a phase (initial phase) of the rotor 402 when driving of the motor 509 is started, θstep represents an increased amount (variation) of θ_ref per driving pulse, and n represents the number of pulses input to the command value generator 500*b*.

<Micro-Step Driving Method>

In the present exemplary embodiment, a micro-step driving method is used in constant current control. The driving method used in constant current control is not limited to the micro-step driving method, but instead may be, for example, a driving method such as a full-step driving method.

Figure 6:
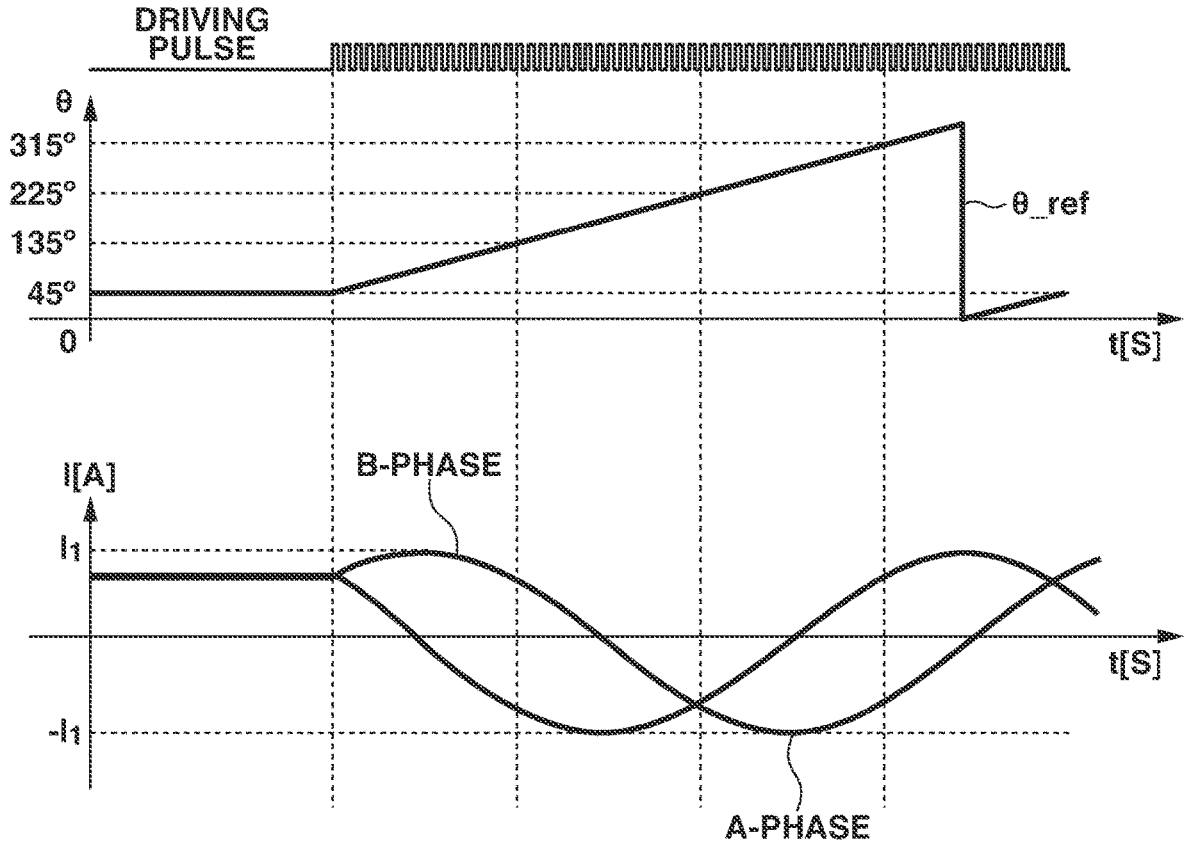
FIG. 6 is a graph illustrating an example of a method for carrying out a micro-step driving method.

FIG. 6 is a graph illustrating an example of a method for carrying out the micro-step driving method. FIG. 6 illustrates the driving pulses output from the CPU 151*a*, the command phase θ_ref generated by the command value generator 500*b*, and the current flowing through the A-phase winding 401*a*/401*c* and B-phase winding 401*b*/401*d*.

The micro-step driving method according to the present exemplary embodiment will be described below with reference to FIGS. 5 and 6. The driving pulses and command phases illustrated in FIG. 6 indicate a state where the rotor 402 is rotated at a constant speed.

In the micro-step driving method, the lead amount of the command phase θ_ref equals the amount (90°/N) obtained by dividing 90 degrees, which is the lead amount of the command phase θ_ref in the full-step driving method, by N is a positive integer). As a result, the current waveform smoothly changes in the shape of a sine wave as illustrated in FIG. 6, which makes it possible to more finely control the rotation phase θ of the rotor 402.

In the case of performing micro-step driving, the command value generator 500*b* generates the command phase θ_ref by the following formula (11) based on the driving pulse output from the CPU 151*a*, and outputs the generated command phase θ_ref.

$$\theta_ref=45°+90/N°*n \quad (11)$$

Thus, upon receiving one driving pulse, the command value generator 500*b* adds 90/N° to the command phase θ_ref, thereby updating the command phase θ_ref. That is, the number of driving pulses output from the CPU 151*a* corresponds to the command phase. The cycle (frequency) of driving pulses output from the CPU 151*a* corresponds to a target speed (command speed) of the rotor 402 of the motor 509.

<Configuration of Developing Device>

Figure 7:
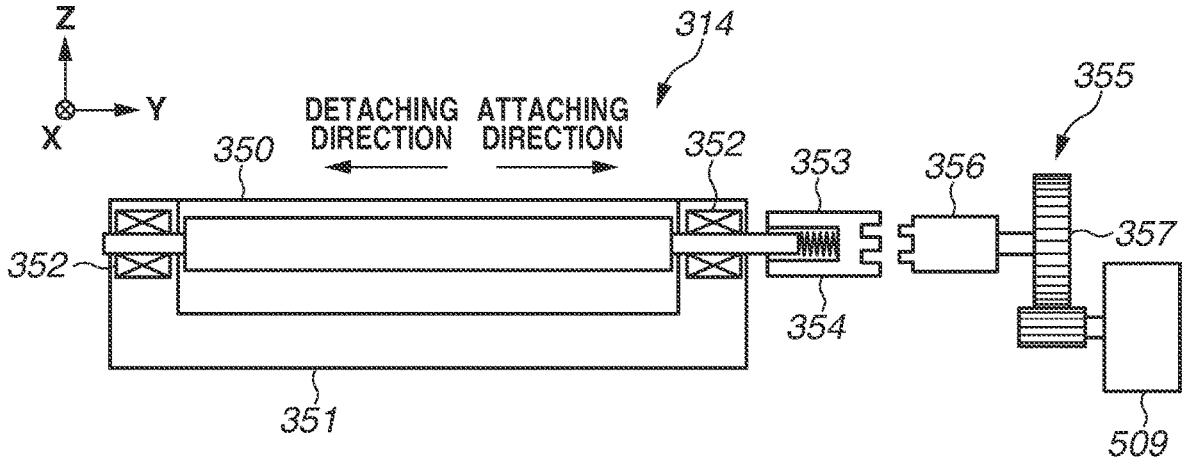
FIG. 7 illustrates a configuration of a developing device.

FIG. 7 illustrates the configuration of the developing device 314 according to the present exemplary embodiment.

The developing device 314 includes the developing roller 350 serving as a rotary member, a container 351, a roller support portion 352, a driven coupling 353 serving as a second coupling, and an urging member 354.

The developing roller 350 is supported by the roller support portion 352, which is provided in the container 351, so that the developing roller 350 is rotated about an axis parallel to a Y-axis illustrated in FIG. 7.

At one end of the developing roller 350, the driven coupling 353 that rotates integrally with the developing roller 350 is provided.

At the one end of the developing roller 350, the urging member 354 that urges the driven coupling 353 against a driving portion 355 is provided in the Y-axis direction.

The driving portion 355 includes a driving coupling 356 serving as a first coupling, a drive transmission gear 357, and the motor 509. The driving force from the motor 509 is transmitted to the driving coupling 356 through the drive transmission gear 357.

In the present exemplary embodiment, the developing device 314 corresponds to an attachable/detachable unit which can be inserted into or removed from the image printing device 301 (inserted into or removed from the driving portion 355) in the Y-axis direction illustrated in FIG. 7, that is, can be detachably attachable to the image printing device 301.

<Configuration for Driving Developing Device 314>

Figure 8:
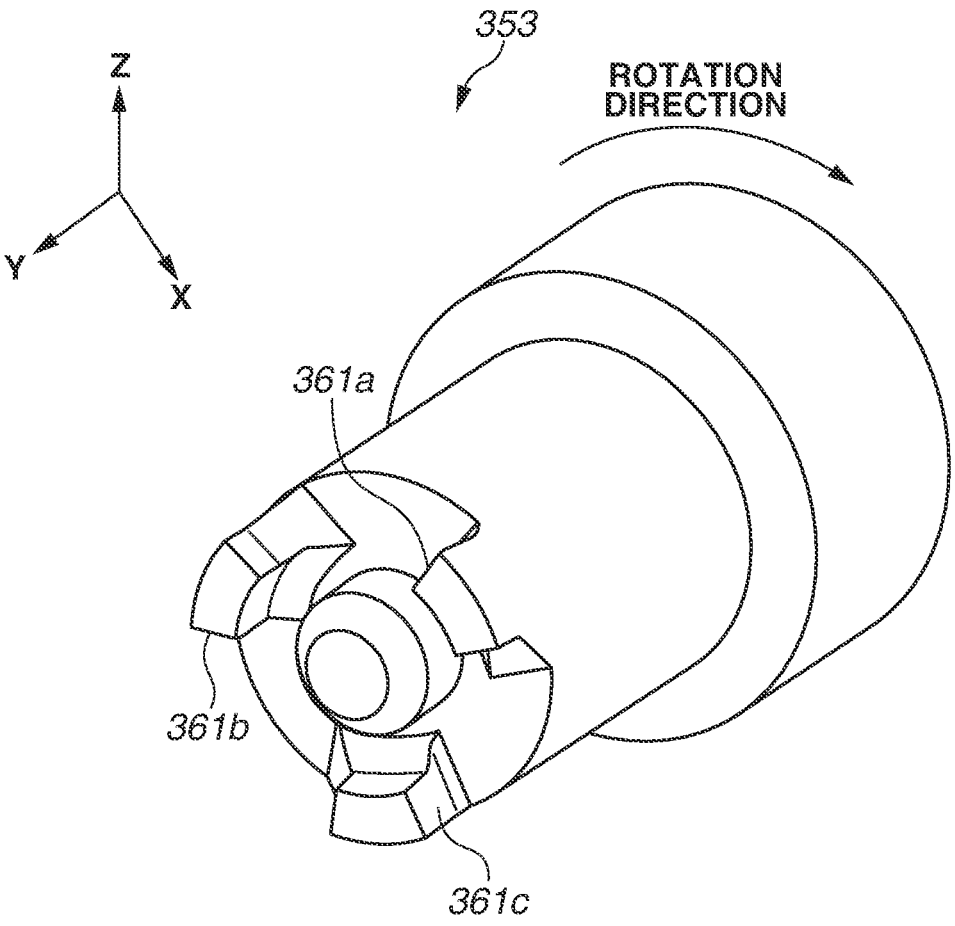
FIG. 8 illustrates a configuration of a driven coupling.

FIG. 8 illustrates the configuration of the driven coupling 353. The driven coupling 353 includes first projecting portions 361*a*, 361*b*, and 361*c* each serving as a projecting portion that projects in an inserting direction (in a direction toward the driving coupling 356 from the driven coupling 353) when the developing device 314 is attached to the image printing device 301. In the present exemplary embodiment, an angle formed in the rotation direction between the center of the first projecting portion 361*a* in the rotation direction and the center of the first projecting portion 361*b* in the rotation direction, an angle formed in the rotation direction between the center of the first projecting portion 361*b* in the rotation direction and the center of the first projecting portion 361*c* in the rotation direction, and an angle formed in the rotation direction between the center of the first projecting portion 361*c* in the rotation direction and the center of the first projecting portion 361*a* in the rotation direction are equal. Specifically, in the present exemplary embodiment, the angle formed in the rotation direction between the center of the first projecting portion 361*a* in the rotation direction and the center of the first projecting portion 361*b* in the rotation direction, the angle formed in the rotation direction between the center of the first projecting portion 361*b* in the rotation direction and the center of the first projecting portion 361*c* in the rotation direction, and the angle formed in the rotation direction between the center of the first projecting portion 361*c* in the rotation direction and the center of the first projecting portion 361*a* in the rotation direction are 120 degrees. That is, the first projecting portions 361*a*, 361*b*, and 361*c* are provided at equal intervals in the rotation direction. However, the arrangement of the first projection portions is not limited to this example. In the present exemplary embodiment, the driven coupling 353 includes three first projecting portions 361*a*, 361*b*, and 361*c*. However, the number of the first projection portions is not limited to three. That is, the number of the first projecting portions 361*a*, 361*b*, and 361*c* provided on the driven coupling 353 may be one or more.

Figure 9:
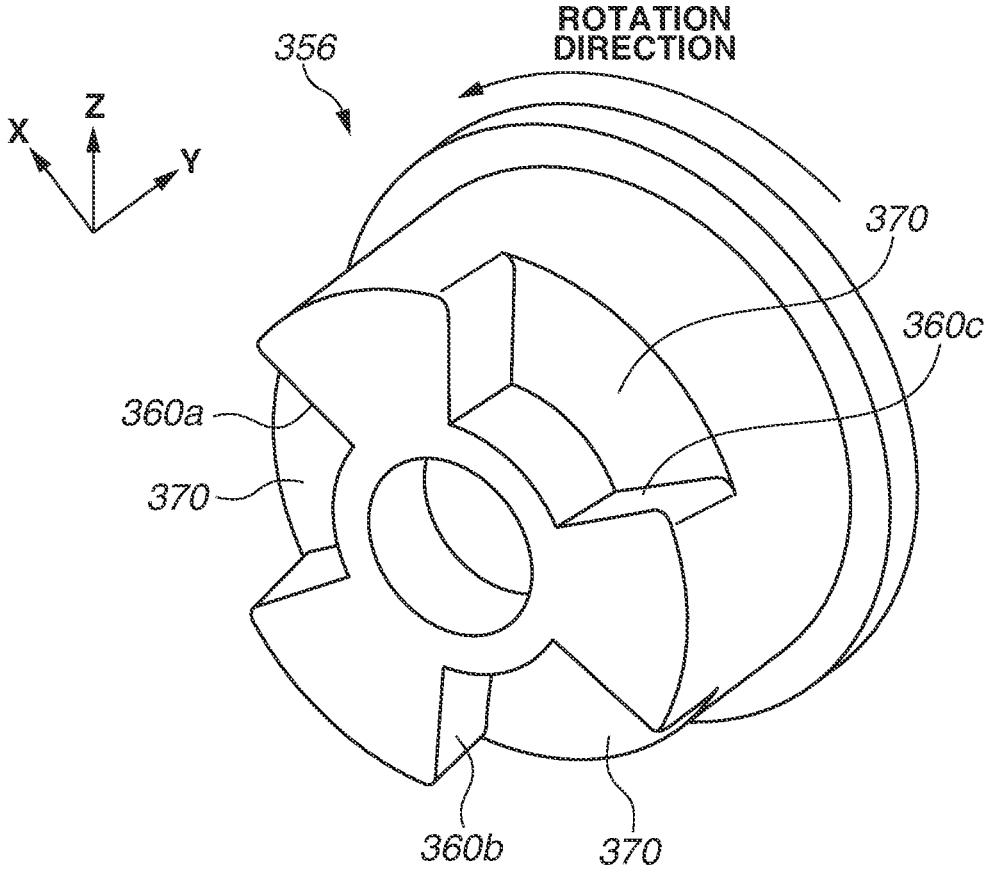
FIG. 9 illustrates a configuration of a driving coupling.

FIG. 9 illustrates the configuration of the driving coupling 356. The driving coupling 356 includes second projecting portions 360*a*, 360*b*, and 360*c* that project in a direction opposite to the inserting direction (in a direction toward the driven coupling 353 from the driving coupling 356). In the present exemplary embodiment, an angle formed in the rotation direction between the center of the second projecting portion 360*a* in the rotation direction and the center of the second projecting portion 360*b* in the rotation direction, an angle formed in the rotation direction between the center of the second projecting portion 360*b* in the rotation direction and the center of the second projecting portion 360*c* in the rotation direction, and an angle formed in the rotation direction between the center of the second projecting portion 360*c* in the rotation direction and the center of the second projecting portion 360*a* in the rotation direction are equal. Specifically, in the present exemplary embodiment, the angle formed in the rotation direction between the center of the second projecting portion 360*a* in the rotation direction and the center of the second projecting portion 360*b* in the rotation direction, the angle formed in the rotation direction between the center of the second projecting portion 360*b* in the rotation direction and the center of the second projecting portion 360*c* in the rotation direction, and the angle formed in the rotation direction between the center of the second projecting portion 360*c* in the rotation direction and the center of the second projecting portion 360*a* in the rotation direction are 120 degrees. That is, the second projecting portions 360*a*, 360*b*, and 360*c* are provided at equal intervals in the rotation direction. However, the arrangement of the second projecting portions 360*a*, 360*b*, and 360*c* is not limited to this example. In the present exemplary embodiment, the driving coupling 356 includes three second projecting portions 360*a*, 360*b*, and 360*c*. However, the number of the second projecting portions is not limited to three. That is, the number of the second projecting portions provided on the driving coupling 356 may be one or more.

Figure 10A:
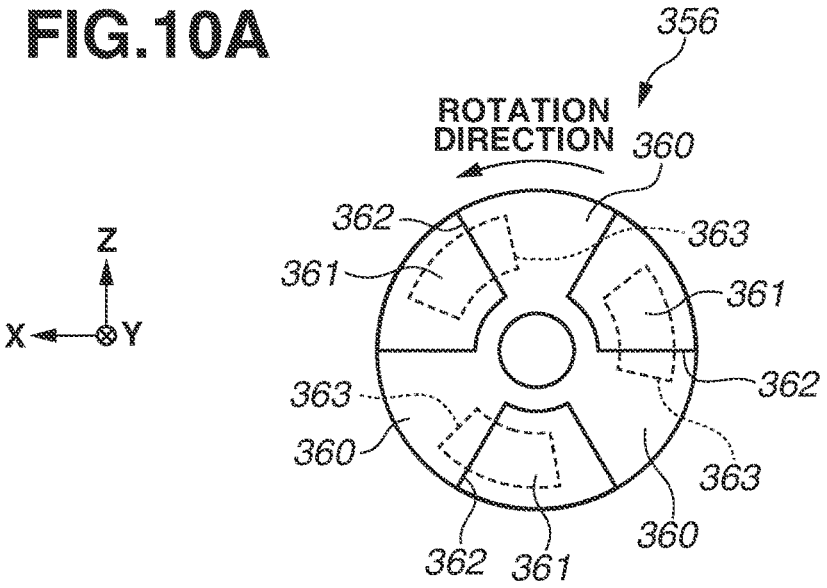
FIGS. 10A, 10B, and 10C each illustrate a rotation phase of the driving coupling and a rotation phase of the driven coupling.
Figure 10B:
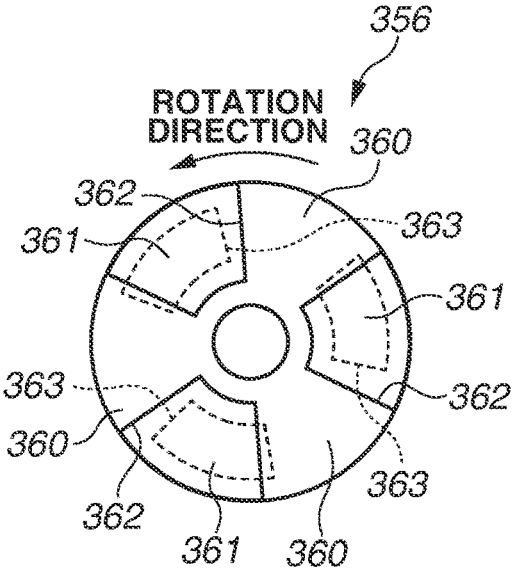
Figure 10C:
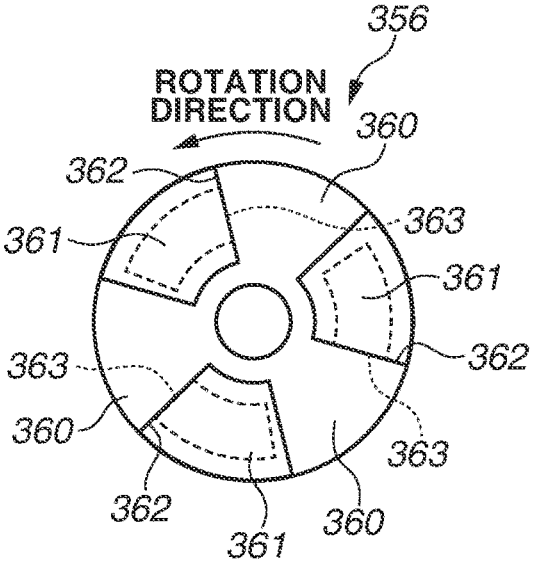

FIGS. 10A, 10B, and 10C each illustrate the rotation phase of the driving coupling 356 and the rotation phase of the driven coupling 353 when the driven coupling 353 is viewed from the driving coupling 356 in the Y-axis direction. In the following description, reference symbols "a", "b", "c" for each of the first projecting portion 361 and the second projecting portion 360 are omitted.

Figure 11A:
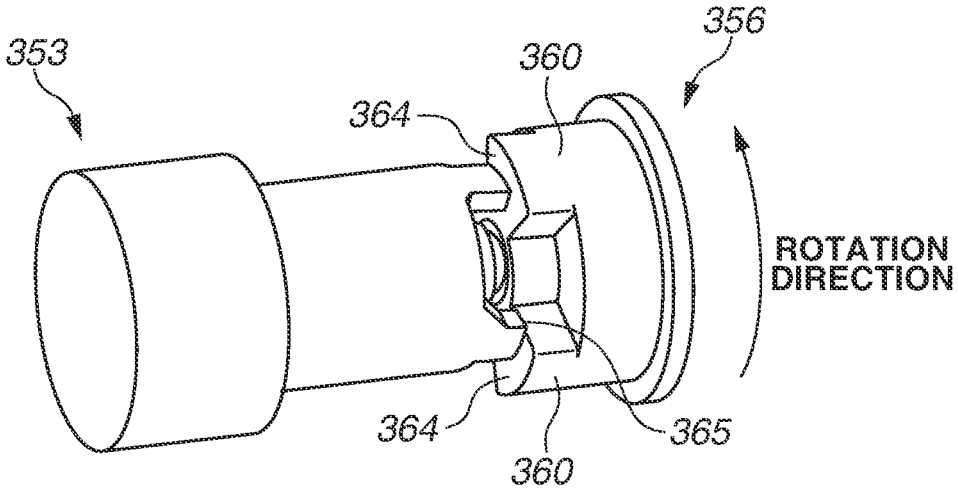
FIGS. 11A and 11B are perspective views each illustrating the driving coupling and the driven coupling.
Figure 11B:
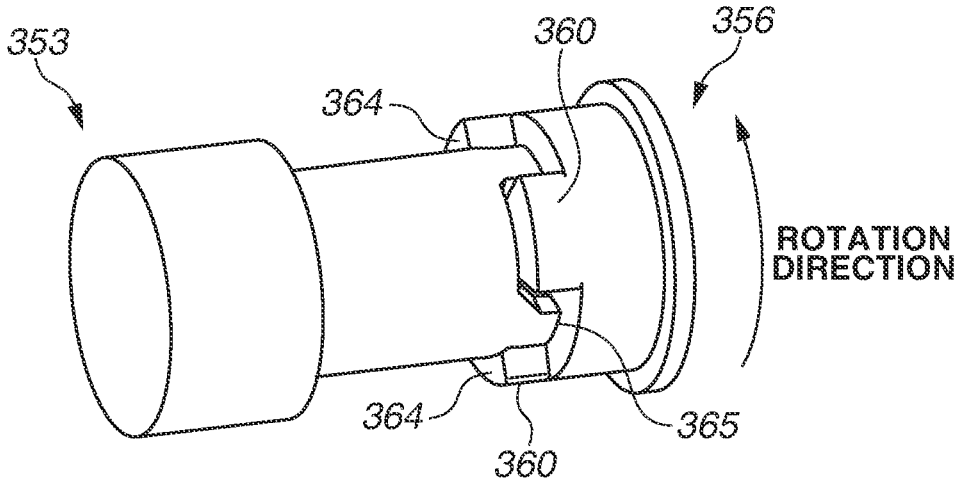

FIGS. 10A and 11B each illustrate a state where at least a part of the first projecting portion 361 overlaps the second projecting portion 360 in the rotation direction of the driving coupling 356. FIG. 10C illustrates a state where the first projecting portion 361 does not overlap the second projecting portion 360 in the rotation direction of the driving coupling 356. In the present exemplary embodiment, the driving coupling 356 is rotated counterclockwise in FIGS. 10A, 10B, and 10C. However, the configuration of the driving coupling 356 is not limited to this example.

In the present exemplary embodiment, the rotation phase of the first projecting portion 361 when the developing device 314 is attached to the image printing device 301 is not uniquely determined. Accordingly, as illustrated in FIGS. 10A, 10B, and 10C, when the developing device 314 is attached to the image printing device 301, the following situationmay occur. That is, at least a part of the first projecting portion 361 overlaps the second projecting portion 360 in the rotation direction, or the first projecting portion 361 does not overlap the second projecting portion 360 in the rotation direction.

FIGS. 11A and 11B are perspective views each illustrating the driving coupling 356 and the driven coupling 353. FIG. 11A is a perspective view illustrating a state where at least a part of the first projecting portion 361 overlaps the second projecting portion 360 in the rotation direction when the developing device 314 is attached to the image printing device 301. FIG. 11B is a perspective view illustrating a state where the first projecting portion 361 does not overlap the second projecting portion 360 in the rotation direction when the developing device 314 is attached to the image printing device 301.

As illustrated in FIG. 11A, when at least a part of the first projecting portion 361 overlaps the second projecting portion 360 in the rotation direction, a regulated surface 365 of the first projecting portion 361 contacts a regulating surface 364 of the second projecting portion 360. The regulated surface 365 and the regulating surface 364 are surfaces crossing each other in the Y-axis direction (inserting direction). The regulated surface 365 and the regulating surface 364 may be planar surfaces or curved surfaces.

In a state where the regulated surface 365 of the first projecting portion 361 contacts the regulating surface 364 of the second projecting portion 360, the driven coupling 353 is urged toward the driving coupling 356 by the urging member 354.

When driving of the motor 509 is started in the state illustrated in FIG. 11A, the driving coupling 356 is rotated while frictionally sliding along the driven coupling 353 in a stopped state (while the regulating surface 364 is frictionally sliding along the regulated surface 365). That is, the driving force from the motor 509 is not transmitted to the driven coupling 353.

After that, when the second projecting portion 360 is rotated to a position where the second projecting portion 360 does not overlap the first projecting portion 361 in the rotation direction, the driven coupling 353 moves toward the driving coupling 356 by the urging force of the urging member 354. As a result, as illustrated in FIG. 11B, each first projecting portion 361 is fit to and corresponds with a recessed portion 370 which is formed between the second projecting portion 360 in the rotation direction.

When the first projecting portion 361 is fit to the recessed portion 370 and the driving coupling 356 is further rotated in the rotation direction, as illustrated in FIG. 10C, a contact surface 362 of the second projecting portion 360 contacts a contacted surface 363 of the first projecting portion 361. Further, when the contact surface 362 presses the contacted surface 363 in the rotation direction, the driven coupling 353 is rotated in the rotation direction. That is, the driving force from the motor 509 is transmitted to the driven coupling 353.

As described above, the driving coupling 356 and the driven coupling 353 are coupled together and the driving force from the motor 509 is transmitted to the developing device 314. The contact surface 362 and the contacted surface 363 may be curved surfaces or planar surfaces.

<Switching between Vector Control and Constant Current Control>

A length of a period D from a time when driving of the driving coupling 356 is started to a time when the driving force from the motor 509 is transmitted to the driven coupling 353 (this period is hereinafter referred to as an idling period) varies depending on the phase of the driven coupling 353 and the phase of the driving coupling 356 when the developing device 314 is attached to the image printing device 301. Specifically, for example, an idling period D_c in the state illustrated in FIG. 10C is shorter than an idling period D_b in the state illustrated in FIG. 10B, and the idling period D_b in the state illustrated in FIG. 10B is shorter than an idling period D_a in the state illustrated in FIG. 10A.

Figure 12A:
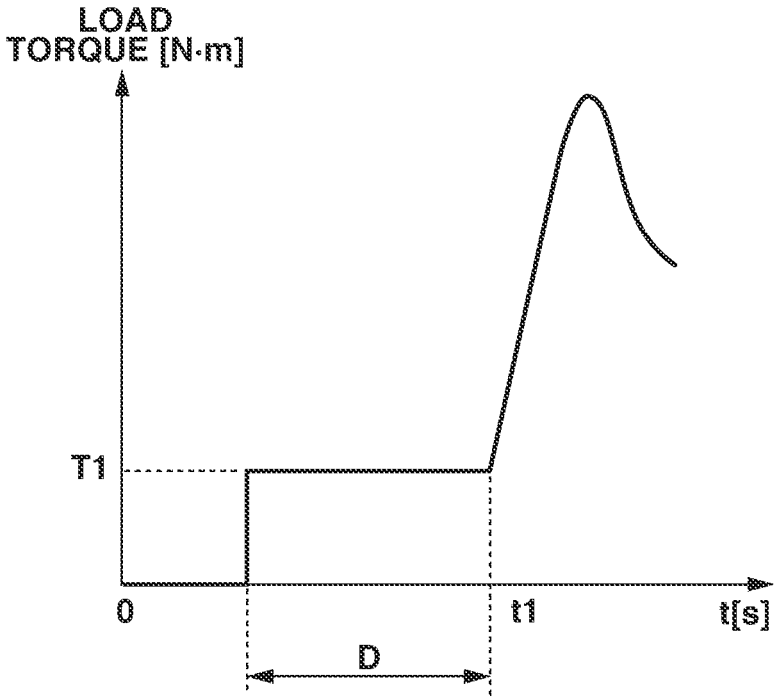
FIGS. 12A and 12B are graphs each illustrating load torque applied to a rotor of the motor and a rotational speed of the rotor of the motor.
Figure 12B:
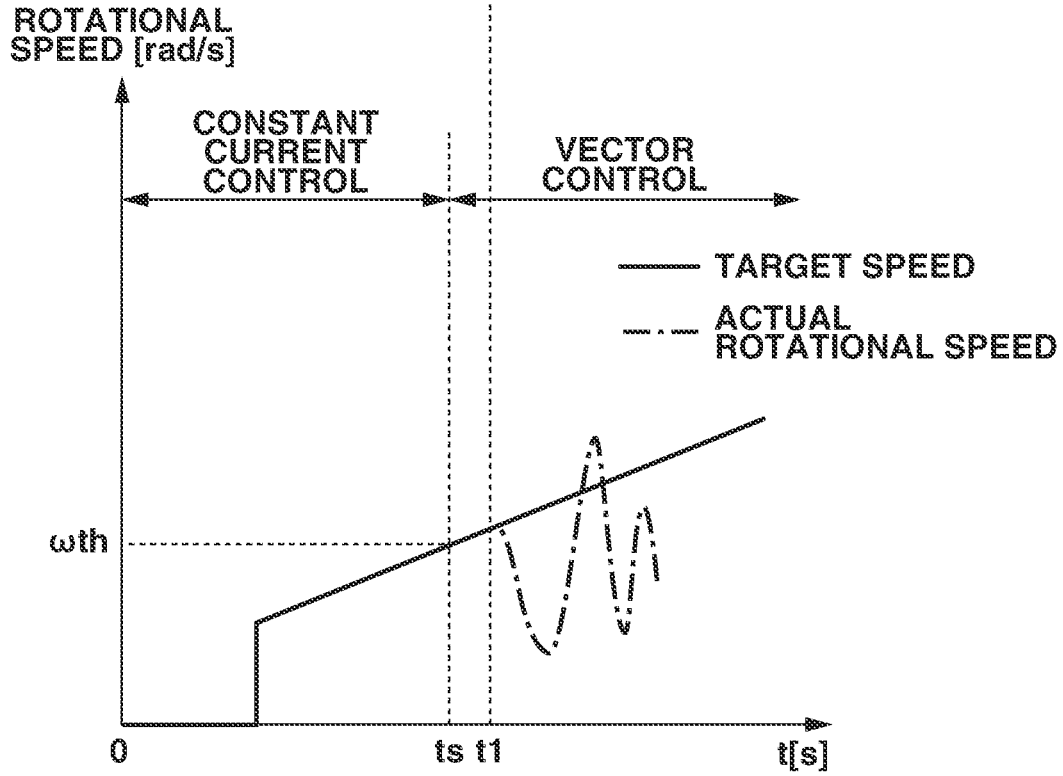

FIGS. 12A and 12B each illustrate the load torque applied to the rotor 402 of the motor 509 and the rotational speed of the motor 509. FIG. 12B illustrates a state an actual rotational speed (indicated by a dashed-dotted line) before time t1 overlaps a target speed (indicated by a solid line).

As illustrated in FIG. 12A, during the idling period D, that is, in a state where the driving force from the motor 509 is not transmitted to the driven coupling 353, load torque T1 for driving the driving coupling 356 is applied to the rotor 402 of the motor 509. At time t1 after the lapse of the idling period D, that is, when the driving force from the motor 509 is transmitted to the driven coupling 353, the load torque applied to the rotor 402 of the motor 509 increases. This is because the load torque for rotating the developing roller 350 in the stopped state is further applied to the rotor 402 of the motor 509. As a result, the actual rotational speed of the rotor 402 of the motor 509 decreases.

In a case where the transmission of the driving force from the motor 509 to the driven coupling 353 is started at a time after time ts, which is when the motor control method is switched from constant current control to vector control, that is, in a case where time ts is later than time 0, the following situation may occur. Specifically, at time t1, the actual rotational speed of the rotor 402 of the motor 509 is smaller than a threshold ωth, which makes it difficult to accurately determine the rotation phase of the rotor 402 of the motor 509. As a result, vector control cannot be accurately performed and thus the motor control operation may become unstable.

Accordingly, in the present exemplary embodiment, the following configuration is applied to prevent the motor control operation from becoming unstable. A method for switching the motor control method according to the present exemplary embodiment will be described below.

As illustrated in FIG. 4, the motor control apparatus 157 according to the present exemplary embodiment includes a configuration for switching constant current control and vector control. Specifically, the motor control apparatus 157 includes a control switch 515 and selection switches 516*a*, 516*b*, and 516*c*. During a period in which constant current control is performed, the induced voltage determiner 512, the phase determiner 513, and the coordinate transformer 519 are operated. During a period in which vector control is performed, one or more circuits for performing constant current control may be operated or suspended.

Figure 13:
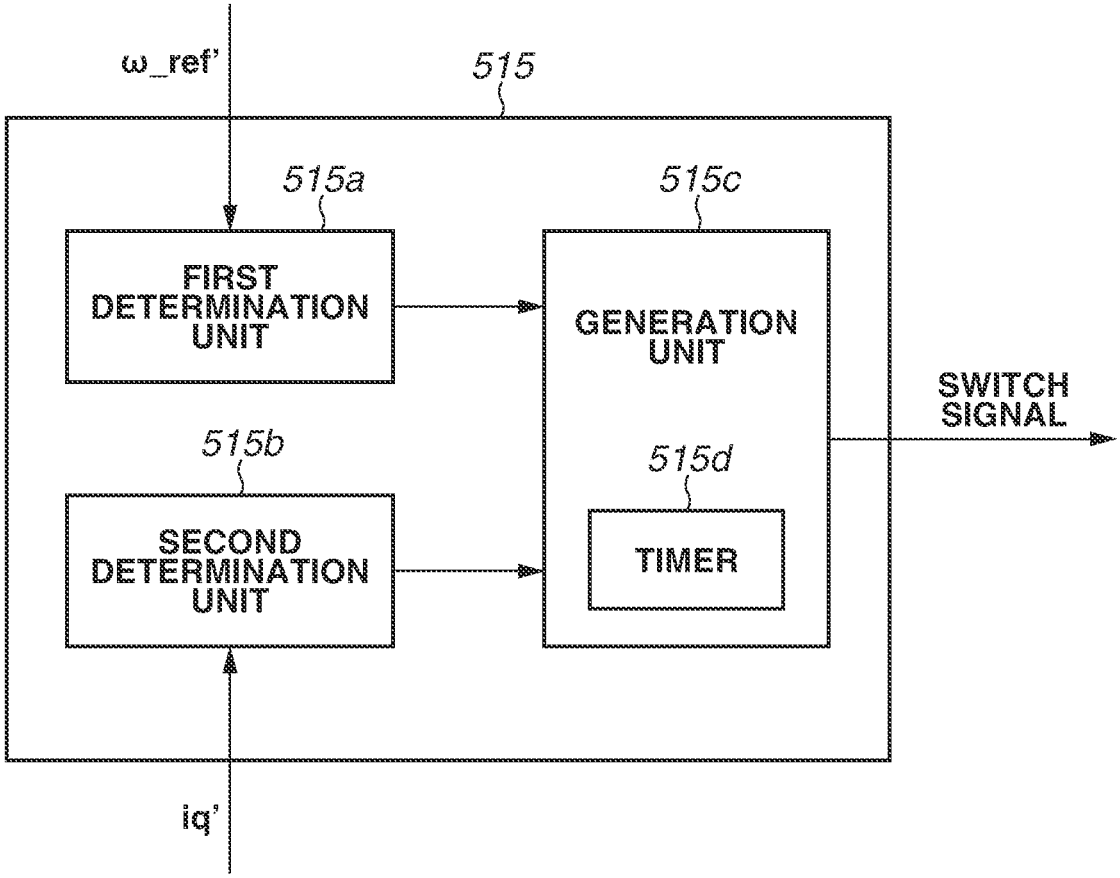
FIG. 13 is a block diagram illustrating a configuration of a control switch.

FIG. 13 is a block diagram illustrating the configuration of the control switch 515. As illustrated in FIG. 13, the control switch 515 includes a first determination unit 515*a*, a second determination unit 515*b*, and a generation unit 515*c*.

The first determination unit 515*a* will be described below. The first determination unit 515*a* receives the rotational speed ω_ref output from the speed generator 500*a*. The first determination unit 515*a* compares the rotational speed ω_ref with the threshold ωth, and outputs the comparison result to the generation unit 515*c*.

The threshold ωth according to the present exemplary embodiment is set to a value greater than a rotational speed ω_min which is a minimum speed among the rotational speeds at which the rotation phase θ can be determined accurately. That is, in vector control, the rotation phase θ can be determined accurately. Also, in constant current control, the rotation phase θ can be determined accurately if the rotational speed of the rotor 402 of the motor 509 is more than or equal to ω_min.

If the rotational speed ω_ref is more than or equal to the threshold wth (ω_ref≥ωth), the first determination unit 515*a* outputs a signal A="H" as the comparison result. On the other hand, if the rotational speed ω_ref is less than the threshold cosh (ω_ref<ωth), the first determination unit 515*a* outputs the signal A="L" as the comparison result. The first determination unit 515*a* outputs the signal A, for example, at the same cycle as the cycle Tin which the CPU 151*a* outputs the rotational speed ω_ref.

Next, the second determination unit 515*b* will be described. The second determination unit 515*b* receives a current value iq' output from the coordinate transformer 519. The current value iq' corresponds to the parameter corresponding to the load torque applied to the rotor 402 of the motor 509.

The second determination unit 515*b* compares the current value iq' input after a lapse of a predetermined time from the time when the driving of the motor 509 is started with a threshold iqth as a predetermined value, and outputs the comparison result to the generation unit 515*c*. The threshold iqth according to the present exemplary embodiment is set to, for example, a value greater than the current value iq corresponding to the load torque applied to the rotor 402 of the motor 509 during the idling period Further, the threshold iqth is set to, for example, a value smaller than the current value iq corresponding to the load torque applied to the rotor 402 of the motor 509 in a state where the motor 509 drives the developing device 314 at a constant speed during the image formation operation. The threshold iqth is, for example, an experimentally obtained value. The predetermined time is, for example, is a time longer than a period from a time when driving of the motor 509 is started to a time when the rotational speed ω_ref reaches ω_min. Further, the predetermined time is, for example, a longest time among the times required for starting the transmission of the driving force from the motor 509 to the driven coupling 353 after driving of the motor 509 is started, that is, a time shorter than an idling period D_max in a case where the idling period D is longest. The predetermined time is, for example, an experimentally obtained time. The idling period D_max is longer than a time for the rotational speed ω_ref to reach ω_min after driving of the motor 509 is started.

If the current value iq' is more than or equal to the threshold iqth (iq'≤iqth), the second determination unit 515*b* outputs a signal B="H" as the comparison result. On the other hand, if the current value iq' is less than the threshold (iq'<iqth), the second determination unit 515*b* outputs the signal B="L" as the comparison result. The second determination unit 515*b* outputs the signal B="L" during a period from a time when driving of the motor 509 is started to a time when a predetermined time has passed. Further, the second determination unit 515*b* outputs the signal B, for example, at the same cycle as the cycle T in which the CPU 151*a* outputs the rotational speed ω_ref.

Next, the generation unit 515*c* will be described. As illustrated in FIG. 13, the generation unit 515*c* includes a timer 515*d* that measures time.

In the case of performing constant current control, the generation unit 515*c* sets a switch signal to "L", and in the case of performing vector control, the generation unit 515*c* sets the switch signal to "H". As illustrated in FIG. 4, the switch signal is input to each of the selection switches 516*a*, 516*b*, and 516*c*. The generation unit 515*c* outputs the switch signal, for example, at the same cycle as the cycle T in which the CPU 151*a* outputs the rotational speed ω_ref.

In a state where constant current control is executed, in a case where time t_m that has elapsed after driving of the motor 509 is started is longer than the idling period D_max, the generation unit 515*c* outputs the switch signal="H", regardless of the signal A and the signal B. As a result, the state of each of the selection switches 516*a*, 516*b*, and 516*c* is switched according to the switch signal, and vector control is performed by the vector controller 518.

In the state where constant current control is executed, if time t_m is less than or equal to the idling period D_max and the signal A="H" and signal B="H" are output, the generation unit 515*c* outputs the switch signal="H". As a result, the state of each of the selection switches 516*a*, 516*b*, and 516*c* is switched according to the switch signal, and vector control is performed by the vector controller 518.

In the state where constant current control is executed, when time t_m is less than or equal to the idling period D_max and at least one of the signal A or the signal B is set to "L", the generation unit 515*c* outputs the switch signal="L". As a result, the state of each of the selection switches 516*a*, 516*b*, and 516*c* is maintained, and constant current control is continued by the constant current controller 517.

In a state where vector control is executed, when signal A="H" is output, the generation unit 515*c* outputs the switch signal="H". As a result, the state of each of the selection switches 516*a*, 516*b*, and 516*c* is maintained, and vector control is continued by the vector controller 518.

In the state where vector control is executed, when the signal A="L" is output, the generation unit 515*c* outputs the switch signal="L". As a result, the state of each of the selection switches 516*a*, 516*b*, and 516*c* is switched according to the switch signal, and constant current control is performed by the constant current controller 517.

Figure 14:
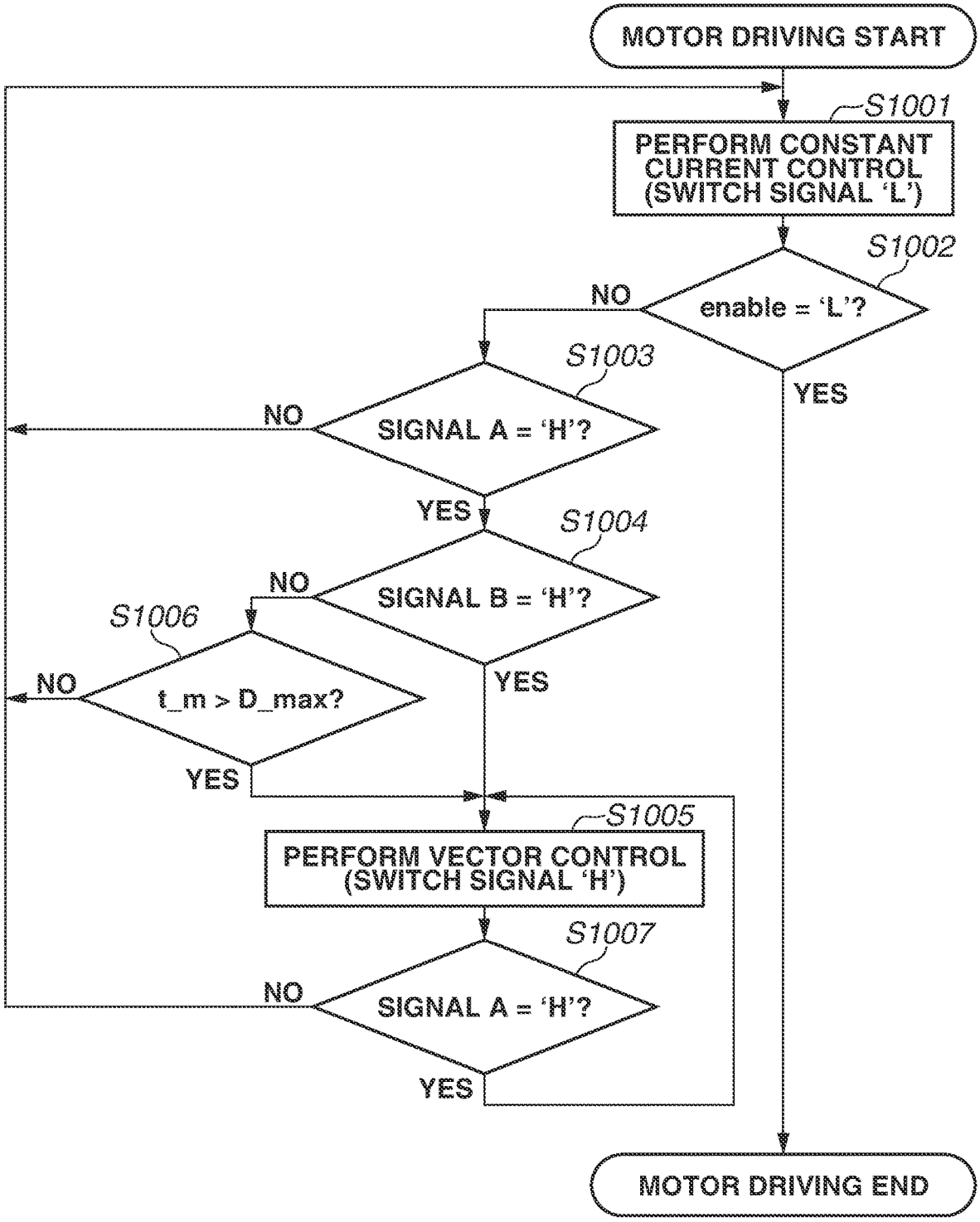

FIG. 14 is a flowchart illustrating a method for controlling the motor 509 by the motor control apparatus 157. A control operation for the motor 509 according to the present exemplary embodiment will be described below with reference to FIG. 14, Processing in this flowchart is executed by the motor control apparatus 157 that has received an instruction from the CPU 151*a*.

First, when the CPU 151*a* outputs an enable signal "H" to the motor control apparatus 157, the motor control apparatus 157 starts driving of the motor 509 based on a command output from the CPU 151*a*. The enable signal is a signal for permitting or prohibiting the operation of the motor control apparatus 157. When the enable signal is at a low level (L), the CPU 151*a* prohibits the operation of the motor control apparatus 157. That is, the control operation for the motor 509 by the motor control apparatus 157 is terminated. Further, when the enable signal is at a high level (H), the CPU 151*a* permits the operation of the motor control apparatus 157 and the motor control apparatus 157 controls the motor509 based on a command output from the CPU 151*a*.

Next, in step S1001, the generation unit 515*c* outputs the switch signal "L" so that driving of the motor 509 can be controlled by the constant current controller 517. As a result, constant current control is performed by the constant current controller 517.

After that, in step S1002, if the CPU 151*a* outputs the enable signal "L" to the motor control apparatus 157 (YES in step S1002), the motor control apparatus 157 terminates driving of the motor 509.

In step S1002, if the CPU 151*a* outputs the enable signal "H" to the motor control apparatus 157 (NO in step S1002), the processing proceeds to step S1003.

Next, in step S1003, if the signal A "L" is output (NO in step S1003), the processing returns to step S1001. That is, the state where constant current control is performed by the constant current controller 517 is maintained.

In step S1003, if the signal A="H" is output (YES in step S1003), the processing proceeds to step S1004.

In step S1004, if the signal B="H" is output (YES in step S1004), the processing proceeds to step S1005. In step S1005, the switch signal "H" is output to each of the selection switches 516*a*, 516*b*, and 516*c*. As a result, vector control is performed by the vector controller 518.

On the other hand, in step 51004, if the signal B="L" is output (NO in step S1004), the processing proceeds to step S1006.

In step S1006, if time t_m is less than or equal to max (NO in step S1006), the processing returns to step S1001. That is, the state where constant current control is performed by the constant current controller 517 is maintained.

In step S1006, if time t_m is more than D_max (YES in step S1000 the processing proceeds to step S1005.

In step S1007, if the signal A="H" is output (YES in step S1007), the processing returns to step S1005. That is, the state where vector control is performed by the vector controller 518 is maintained.

In step S1007, if the signal A="L" is output (NO in step S1007), the processing returns to step S1001. In step S1001, the switch signal "L" is output to each of the selection switches 516*a*, 516*b*, and 516*c*. As a result, constant current control is performed by the constant current controller 517.

Then, the motor control apparatus 157 repeatedly performs the above-described control operation until the CPU 151*a* outputs the enable signal "L" to the motor control apparatus 157. Also, when vector control is being executed, if the CPU 151*a* outputs the enable signal "L" to the motor control apparatus 157, the motor control apparatus 157 suspends the motor control operation.

As described above, in the present exemplary embodiment, the motor control method is switched from constant current control to vector control after the transmission of the driving force from the motor 509 to the developing device 314 is resumed. Consequently, it is possible to prevent the motor controloperation from becoming unstable.

The present exemplary embodiment described above illustrates a configuration for switching the motor control method for controlling the motor 509 that rotationally drives the developing device 314. However, the configuration for switching the control method according to the present exemplary embodiment is not applied only to the developing device 314. For example, the configuration for switching the control method according to the present exemplary embodiment is also applicable to a unit (e.g., a drum unit including a photosensitive drum) that can be inserted into or removed from the image printing device 301 and is rotationally driven when the unit is attached to the image printing device 301.

In the present exemplary embodiment, the driving force is transmitted from the driving coupling 356 to the driven coupling 353 in a state where the first projecting portion 361 provided on the driven coupling 353 is fit to the recessed portion 370 provided on the driving coupling 356. However, the present exemplary embodiment is not limited to this example. For example, the driving force may be transmitted from the driving coupling 356 to the driven coupling 353 in a state where a projecting portion provided on the driving coupling 356 is fit to the recessed portion 370 provided on the driven coupling 353. In other words, any configuration may be employed as long as one of the driving coupling 356 and the driven coupling 353 includes a projecting portion, and the other one of the driving coupling 356 and the driven coupling 353 includes the recessed portion 370.

Further, in the present exemplary embodiment, the length of the projecting portion 361 in the rotation direction is shorter than the length of the recessed portion 370 in the rotation direction. However, the present exemplary embodiment is not limited to this example, For example, the length of the projecting portion 361 in the rotation direction may be the same as the length of the recessed portion 370 in the rotation direction.

In the present exemplary embodiment, the urging member 354 that urges the driven coupling 353 against the driving portion 355 in the Y-axis direction is provided at one end of the developing roller 350. However, the present exemplary embodiment is not limited to this example. For example, the driving portion 355 may be provided with the urging member 354 in such a manner that the urging member 354 urges the driving coupling 356 against the developing device 314 in the Y-axis direction.

In vector control according to the present exemplary embodiment, the motor 509 is controlled by performing phase feedback control. However, the present exemplary embodiment is not limited to this configuration. For example, a configuration in which the motor 509 is controlled by feeding back a rotational speed w of the rotor 402 may be employed. Specifically, as illustrated in FIG. 15, the CPU 151*a* outputs a command speed ω_ref representing the target speed of the rotor 402. Further, a speed determiner 514 provided in the motor control apparatus 157 determines the rotational speed w based on a time change of the rotation phase θ output from the phase determiner 513. To determine the speed, the following formula (12) is used.

$$\omega = d\theta/dt \tag{12}$$

A speed controller 600 is configured to generate the q-axis current command value iq_ref so as to reduce a deviation between the rotational speed ω and the command speed ω_ref and output the generated q-axis current command value iq_ref. The motor 509 may be controlled by performing speed feedback control in this manner. In the configuration in which the rotational speed is fed back as described above, the rotational speed of the rotor 402 can be controlled to a predetermined speed.

FIG. 15 is a block diagram illustrating the configuration of the motor control apparatus that performs speed feedback control. In the present exemplary embodiment, the first determination unit 515*a*. compares the target speed ω_ref of the rotor 402 with the threshold wth, and outputs the signal A. However, the configuration of the first determination unit 515*a* according to the present exemplary embodiment is not limited to this example. For example, the first determination unit 515*a* may compare the rotational speed ω determined by the speed determiner 514 illustrated in FIG. 15 with the threshold ωth, and may output the signal A.

The motor control apparatus 157 according to the present exemplary embodiment corresponds to the portion (the current controller 503, the PWM inverter 506, and the like) that is partially shared between one or more circuits for performing vector control and one or more circuits for performing constant current control. However, the configuration of the motor control apparatus 157 is not limited to this example. For example, one or more circuits for performing vector control and one or more circuits for performing constant current control may be independently provided.

The rotational speed ω_ref may be determined based on, for example, a cycle in which the magnitude of periodic signals, such as the drive current iα or iβ, the drive voltage Vα or Vβ, and the induced voltage Eα or Eβ, which have a correlation with the rotation cycle of the rotor 402 becomes zero.

Further, in the present exemplary embodiment, a stepping motor is used as the motor 509 that drives a load. However, other motors such as a direct current (DC) motor or a brushless DC motor may be used. The motor is not limited to a two-phase motor. The present exemplary embodiment is also applicable to other motors such as a three-phase motor.

Further, in the present exemplary embodiment, a permanent magnet is used as the rotor 402. However, the rotor 402 is not limited to a permanent magnet.

According to an aspect of the present disclosure, it is possible to prevent a motor control operation from becoming unstable.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™, a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2019-108892, filed Jun. 11, 2019, which is hereby incorporated by reference herein in its entirety.

What is claimed is:

1. An image forming apparatus to form an image on a sheet, the image forming apparatus comprising:

a motor;

a first coupling configured to transmit a driving force from the motor;

an attachable/detachable unit configured to be detachably attached to the image forming apparatus, wherein the attachable/detachable unit includes a second coupling configured to transmit the driving force from the first coupling to a rotary member included in the attachable/detachable unit;

a detector configured to detect a drive current flowing through a winding of the motor;

a phase determiner configured to determine a rotation phase of a rotor of the motor based on the drive current detected by the detector; and a controller including (i) a first control mode for controlling the drive current flowing through the winding to reduce a deviation between a command phase representing a target phase of the rotor and the rotation phase determined by the phase determiner, and (ii) a second control mode for controlling the drive current flowing through the winding based on a current of a predetermined magnitude, wherein one of the first coupling and the second coupling includes a projecting portion, and the other one of the first coupling and the second coupling includes a recessed portion corresponding to the projecting portion, wherein, in a state where the projecting portion is engaged with the recessed portion, the second coupling is rotated by being pressed in a rotation direction by the first coupling rotationally driven by the motor, wherein the controller starts driving of the motor in the second control mode, and wherein, in a case where a value corresponding to load torque applied to the rotor is greater than a first predetermined value and a value corresponding to a rotational speed of the rotor is greater than a second predetermined value in a state where the second control mode is executed, the controller switches a control mode for controlling the drive current from the second control mode to the first control mode.

2. The image forming apparatus according to claim 1, wherein one of the first coupling and the second coupling includes a plurality of projecting portions, and wherein the other one of the first coupling and the second coupling is provided with a plurality of recessed portions respectively corresponding to the plurality of projecting portions.

3. The image forming apparatus according to claim 1, wherein the recessed portion is provided on the first coupling and the projecting portion is provided on the second coupling.

4. The image forming apparatus according to claim 1, wherein the attachable/detachable unit includes an urging member configured to urge the second coupling against the first coupling.

5. The image forming apparatus according to claim 1, further comprising an urging member configured to urge the first coupling against the second coupling.

6. The image forming apparatus according to claim 1, further comprising a photosensitive member and a transfer portion, wherein the attachable/detachable unit is a developing unit that includes a developer bearing member as the rotary member configured to bear developer for developing a latent image formed on the photosensitive member, and wherein the transfer portion is configured to transfer, onto the sheet, a toner image formed on the photosensitive member by the developing unit.

7. The image forming apparatus according to claim 1, further comprising a developer bearing member, configured to bear developer, and a transfer portion, wherein the attachable/detachable unit is a drum unit that includes a photosensitive drum as the rotary member configured to bear a toner image developed by the developer, and wherein the transfer portion is configured to transfer, onto the sheet, the toner image formed on the photosensitive drum.

8. The image forming apparatus according to claim 1, further comprising a speed determiner configured to determine the rotational speed of the rotor, wherein the value corresponding to the rotational speed of the rotor is a value indicating the rotational speed determined by the speed determiner.

9. The image forming apparatus according to claim 1, wherein the value corresponding to the rotational speed of the rotor is a value indicating a target speed of the rotor.

10. The image forming apparatus according to claim 1, wherein the first control mode is a control mode for controlling the drive current based on a torque current component, configured to generate torque in the rotor, and represented in a rotating coordinate system based on the rotation phase determined by the phase determiner.

11. The image forming apparatus according to claim 10, wherein the value corresponding to the load torque is a value indicating the torque current component of the drive current detected by the detector.

12. The image forming apparatus according to claim 1, further comprising an induced voltage determiner configured to determine an induced voltage induced to the winding by rotation of the rotor based on the drive current detected by the detector, wherein the phase determiner determines the rotation phase of the rotor based on the induced voltage determined by the induced voltage determiner.

13. An image forming apparatus to form an image on a sheet, the image forming apparatus comprising:

a motor;

a first coupling configured to transmit a driving force from the motor;

an attachable/detachable unit configured to be detachably attached to the image forming apparatus, wherein the attachable/detachable unit includes a second coupling configured to transmit the driving force from the first coupling to a rotary member included in the attachable/detachable unit;

a detector configured to detect a drive current flowing through a winding of the motor;

a speed determiner configured to determine a rotational speed of a rotor of the motor based on the drive current detected by the detector; and a controller including (i) a first control mode for controlling the drive current flowing through the winding to reduce a deviation between a command speed representing a target speed of the rotor and the rotational speed determined by the speed determiner, and (ii) a second control mode for controlling the drive current flowing through the winding based on a current of a predetermined magnitude, wherein one of the first coupling and the second coupling includes a projecting portion, and the other one of the first coupling and the second coupling includes a recessed portion corresponding to the projecting portion, wherein, in a state where the projecting portion is engaged with the recessed portion, the second coupling is rotated by being pressed in a rotation direction by the first coupling rotationally driven by the motor, wherein the controller starts driving of the motor in the second control mode, and wherein, in a case where a value corresponding to load torque applied to the rotor is greater than a first predetermined value and a value corresponding to the rotational speed of the rotor is greater than a second predetermined value in a state where the second control mode is executed, the controller switches a control mode for controlling the drive current from the second control mode to the first control mode.

14. The image forming apparatus according to claim 13, wherein one of the first coupling and the second coupling includes a plurality of projecting portions, and wherein the other one of the first coupling and the second coupling is provided with a plurality of recessed portions respectively corresponding to the plurality of projecting portions.

15. The image forming apparatus according to claim 13, wherein the recessed portion is provided on the first coupling and the projecting portion is provided on the second coupling.

16. The image forming apparatus according to claim 13, wherein the attachable/detachable unit includes an urging member configured to urge the second coupling against the first coupling.

17. The image forming apparatus according to claim 13, further comprising an urging member configured to urge the first coupling against the second coupling.

18. The image forming apparatus according to claim 13, further comprising a photosensitive member and a transfer portion, wherein the attachable/detachable unit is a developing unit that includes a developer bearing member as the rotary member configured to bear developer for developing a latent image formed on the photosensitive member, and wherein the transfer portion is configured to transfer, onto the sheet, a toner image formed on the photosensitive member by the developing unit.

19. The image forming apparatus according to claim 13, further comprising a developer bearing member, configured to bear developer, and a transfer portion, wherein the attachable/detachable unit is a drum unit that includes a photosensitive drum as the rotary member configured to bear a toner image developed by the developer, and wherein the transfer portion is configured to transfer, onto the sheet, the toner image formed on the photosensitive drum.

20. The image forming apparatus according to claim 13, wherein the value corresponding to the rotational speed of the rotor is a value indicating the rotational speed determined by the speed determiner.

21. The image forming apparatus according to claim 13, wherein the value corresponding to the rotational speed of the rotor is a value indicating the target speed of the rotor.

22. The image forming apparatus according to claim 13, further comprising a phase determiner configured to determine a rotation phase of the rotor, wherein the first control mode is a control mode for controlling the drive current based on a torque current component, configured to generate torque in the rotor, and represented in a rotating coordinate system based on the rotation phase determined by the phase determiner.

23. The image forming apparatus according to claim 22, wherein the value corresponding to the load torque is a value indicating the torque current component of the drive current detected by the detector.

24. The image forming apparatus according to claim 13, further comprising an induced voltage determiner configured to determine an induced voltage induced to the winding by rotation of the rotor based on the drive current detected by the detector, wherein the speed determiner determines the rotational speed of the rotor based on the induced voltage determined by the induced voltage determiner.

25. A motor control apparatus comprising:

a detector configured to detect a drive current flowing through a winding of a motor;

a phase determiner configured to determine a rotation phase of a rotor of the motor based on the drive current detected by the detector; and a controller including (i) a first control mode for controlling the drive current flowing through the winding to reduce a deviation between a command phase representing a target phase of the rotor and the rotation phase determined by the phase determiner, and (ii) a second control mode for controlling the drive current flowing through the winding based on a current of a predetermined magnitude, wherein the controller starts driving of the motor in the second control mode, and wherein, in a case where a value corresponding to load torque applied to the rotor is greater than a first predetermined value and a value corresponding to a rotational speed of the rotor is greater than a second predetermined value in a state where the second control mode is executed, the controller switches a control mode for controlling the drive current from the second control mode to the first control mode.

26. The motor control apparatus according to claim 25, further comprising a speed determiner configured to determine the rotational speed of the rotor, wherein the value corresponding to the rotational speed of the rotor is a value indicating the rotational speed determined by the speed determiner.

27. The motor control apparatus according to claim 25, wherein the value corresponding to the rotational speed of the rotor is a value indicating a target speed of the rotor.

28. The motor control apparatus according to claim 25, wherein the first control mode is a control mode for controlling the drive current based on a torque current component, configured to generate torque in the rotor, and represented in a rotating coordinate system based on the rotation phase determined by the phase determiner.

29. The motor control apparatus according to claim 28, wherein the value corresponding to the load torque is a value indicating the torque current component of the drive current detected by the detector.

30. The motor control apparatus according to claim 25, further comprising an induced voltage determiner configured to determine an induced voltage induced to the winding by rotation of the rotor based on the drive current detected by the detector, wherein the phase determiner determines the rotation phase of the rotor based on the induced voltage determined by the induced voltage determiner.

31. A motor control apparatus comprising:

a detector configured to detect a drive current flowing through a winding of a motor;

a speed determiner configured to determine a rotational speed of a rotor of the motor based on the drive current detected by the detector; and a controller including (i) a first control mode for controlling the drive current flowing through the winding to reduce a deviation between a command speed representing a target speed of the rotor and the rotational speed determined by the speed determiner, and (ii) a second control mode for controlling the drive current flowing through the winding based on a current of a predetermined magnitude, wherein the controller starts driving of the motor in the second control mode, and wherein, in a case where a value corresponding to load torque applied to the rotor is greater than a first predetermined value and a value corresponding to the rotational speed of the rotor is greater than a second predetermined value in a state where the second control mode is executed, the controller switches a control mode for controlling the drive current from the second control mode to the first control mode.

32. The motor control apparatus according to claim 31, wherein the value corresponding to the rotational speed of the rotor is a value indicating the rotational speed determined by the speed determiner.

33. The motor control apparatus according to claim 31, wherein the value corresponding to the rotational speed of the rotor is a value indicating the target speed of the rotor.

34. The motor control apparatus according to claim 31, further comprising a phase determiner configured to determine a rotation phase of the rotor, wherein the first control mode is a control mode for controlling the drive current based on a torque current component, configured to generate torque in the rotor, and represented in a rotating coordinate system based on the rotation phase determined by the phase determiner.

35. The motor control apparatus according to claim 34, wherein the value corresponding to the load torque is a value indicating the torque current component of the drive current detected by the detector.

36. The motor control apparatus according to claim 31, further comprising an induced voltage determiner configured to determine an induced voltage induced to the winding by rotation of the rotor based on the drive current detected by the detector, wherein the speed determiner determines the rotational speed of the rotor based on the induced voltage determined by the induced voltage determiner.

* * * * *